US009976242B2

(12) United States Patent
Ryoo et al.

(10) Patent No.: US 9,976,242 B2
(45) Date of Patent: May 22, 2018

(54) CLOTHES TREATING APPARATUS WITH A HEAT PUMP CYCLE

(71) Applicant: LG ELECTRONICS INC., Seoul (KR)

(72) Inventors: Byeongjo Ryoo, Seoul (KR); Daeyun Park, Seoul (KR); Yongju Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 145 days.

(21) Appl. No.: 14/959,883

(22) Filed: Dec. 4, 2015

(65) Prior Publication Data

US 2016/0160419 A1 Jun. 9, 2016

(30) Foreign Application Priority Data

Dec. 8, 2014 (KR) ..... 10-2014-0175160

(51) Int. Cl.
*D06F 25/00* (2006.01)
*D06F 33/02* (2006.01)
(Continued)

(52) U.S. Cl.
CPC ..... *D06F 25/00* (2013.01); *D06F 33/02* (2013.01); *D06F 58/206* (2013.01); *D06F 58/28* (2013.01);
(Continued)

(58) Field of Classification Search
CPC ..... D06F 25/00; D06F 33/02; D06F 39/04; D06F 39/088; D06F 58/20; D06F 58/206;
(Continued)

(56) References Cited

U.S. PATENT DOCUMENTS 4,268,247 A 5/1981 Freze
5,315,765 A 5/1994 Holst et al.
(Continued)

FOREIGN PATENT DOCUMENTS

CN 1465764 1/2004
CN 1503864 6/2004
(Continued)

OTHER PUBLICATIONS

Machine translation of JP 2013-081634 A, published May 9, 2013.*
(Continued)

*Primary Examiner* — Joseph L. Perrin
(74) *Attorney, Agent, or Firm* — Ked & Associates, LLP

(57) ABSTRACT

A clothes treating apparatus having a heat pump cycle for performing a washing cycle and a drying cycle is provided. The clothes treating apparatus may include a drum configured to accommodate a item to be treated; a heat pump cycle having a first evaporator, a compressor, a condenser, and an expansion valve to heat air introduced into the drum; a circulation duct configured to form a circulation passage of air that has passed through the drum; a circulation fan configured to circulate the air; and a controller configured to drive the heat pump cycle and the circulation fan during the washing cycle to preheat at least one of the drum or the circulation duct.

11 Claims, 13 Drawing Sheets

(51) Int. Cl.

| | |
|---|---|
| ***D06F 58/20*** | (2006.01) |
| ***D06F 58/28*** | (2006.01) |
| *D06F 39/04* | (2006.01) |
| *D06F 39/08* | (2006.01) |

(52) U.S. Cl.
CPC ..... *D06F 39/04* (2013.01); *D06F 39/088* (2013.01); *D06F 58/20* (2013.01); *D06F 2058/287* (2013.01); *D06F 2058/2864* (2013.01)

(58) Field of Classification Search
CPC .. D06F 58/26; D06F 58/28; D06F 2058/2864; D06F 2058/287
See application file for complete search history.

(56) References Cited

U.S. PATENT DOCUMENTS

| | | | | |
|---|---|---|---|---|
| 6,484,417 | B2 | 11/2002 | Tedman et al. | |
| 7,191,543 | B2 * | 3/2007 | Yakumaru | D06F 58/206 34/77 |
| 2004/0079121 | A1 * | 4/2004 | Yabuuchi | D06F 25/00 68/19.2 |
| 2005/0066538 | A1 | 3/2005 | Goldberg et al. | |
| 2005/0246920 | A1 * | 11/2005 | Yabuuchi | D06F 58/02 34/515 |
| 2008/0235977 | A1 | 10/2008 | Kuwabara | |
| 2009/0126220 | A1 | 5/2009 | Nawrot et al. | |
| 2010/0024239 | A1 | 2/2010 | Kono et al. | |
| 2011/0030238 | A1 | 2/2011 | Nawrot et al. | |
| 2011/0277334 | A1 * | 11/2011 | Lee | D06F 58/203 34/73 |
| 2011/0280736 | A1 * | 11/2011 | Lee | D06F 58/206 417/26 |
| 2011/0289794 | A1 * | 12/2011 | Noh | D06F 58/206 34/443 |
| 2012/0186305 | A1 | 7/2012 | Taniguchi et al. | |
| 2015/0259847 | A1 * | 9/2015 | Kohavi | F16L 53/00 34/468 |
| 2016/0160419 | A1 | 6/2016 | Ryoo et al. | |
| 2016/0160430 | A1 | 6/2016 | Lee et al. | |

FOREIGN PATENT DOCUMENTS

| | | | | |
|---|---|---|---|---|
| CN | 1886628 | | 12/2006 | |
| CN | 102433722 | | 5/2012 | |
| DE | 43 06 217 | A1 | 9/1994 | |
| DE | 102 55 575 | C1 | 12/2003 | |
| DE | 20 2015 106 435 | | 2/2016 | |
| EP | 2 599 912 | | 6/2013 | |
| EP | 2746454 | A1 * | 6/2014 | D06F 58/206 |
| JP | 2005-024113 | A | 1/2005 | |
| JP | 2006-149759 | A | 6/2006 | |
| JP | 2006-296449 | A | 11/2006 | |
| JP | 2007-222456 | A | 9/2007 | |
| JP | 2007-301290 | A | 11/2007 | |
| JP | 2008-142101 | A | 6/2008 | |
| JP | 2008-220814 | A | 9/2008 | |
| JP | 2010-069079 | A | 4/2010 | |
| JP | 2013-081634 | A | 5/2013 | |
| KR | 10-2005-0063968 | | 6/2005 | |
| KR | 2006-0033188 | | 4/2006 | |
| KR | 10-0587358 | | 6/2006 | |
| KR | 2006-0089073 | | 8/2006 | |
| KR | 10-0629343 | | 9/2006 | |
| KR | 10-1312399 | | 9/2013 | |
| KR | 10-1337699 | B1 | 12/2013 | |
| WO | WO 2014/095658 | | 6/2014 | |

OTHER PUBLICATIONS

Korean Office Action dated Jul. 9, 2015 issued in Application No. 10-2014-0175165.
U.S. Office Action dated Jan. 17, 2017 issued in co-pending U.S. Appl. No. 14/945,832.
Chinese Office Action dated May 15, 2017 issued in Application No. 201510883500.9 (with English Translation).
Chinese Office Action dated May 22, 2017 issued in Application No. 201510895181.3 (with English Translation).
Australian Office Action dated Jun. 30, 2016 issued in Application No. 2015264797.
European Search Report issued in Application No. 15197566.1 dated Apr. 20, 2016.
Korean Office Action issued in Application No. 10-2014-0175160 dated Jul. 9, 2015.

* cited by examiner

CLOTHES TREATING APPARATUS WITH A HEAT PUMP CYCLE

CROSS-REFERENCE TO RELATED APPLICATION(S)

Pursuant to 35 U.S.C. § 119(a), this application claims priority to Korean Application No. 10-2014-0175160, filed in Korea on Dec. 8, 2014, the contents of which is incorporated by reference herein in its entirety.

BACKGROUND

1. Field

A clothes treating apparatus with a heat pump cycle is disclosed herein.

2. Background

In general, a clothes treating apparatus having a drying function, such as a washer or dryer, is a device that upon completion of washing and dehydration cycles, supplies hot air into a drum containing laundry to evaporate moisture from the laundry and dry out the laundry. The clothes treating apparatus may be categorized as an exhaust type clothes dryer or a condensation type clothes dryer according to a method of treating humid air that has passed through the drum after drying the laundry. The exhaust type clothes dryer may exhaust humid air coming out of the drum outside of the dryer, and the condensation type clothes dryer may cool down humid air to below its dew point temperature by circulating the humid air through a condenser without exhausting it outside of the dryer to condense moisture contained in the humid air.

The condensation type clothes dryer may heat condensate water condensed in the condenser and then introduce heated air into a drum. Humid air may be cooled down during the condensation process to generate a loss of thermal energy, and thus, an additional heater is required to heat the air up to a temperature required for drying.

The exhaust type dryer may also be required to heat humid air up to a required temperature level using a heater, for example, to exhaust it outside of the dryer and introduce air at room temperature. In particular, a humidity of air exhausted from an outlet of the drum may decrease during the drying cycle, causing a loss of heat in the air exhausted to the outside, which is not being used to dry laundry, thereby decreasing thermal efficiency.

Accordingly, in recent years, clothes dryers having a heat pump cycle capable of collecting energy exhausted out of a drum and using energy to heat air introduced into the drum to increase energy efficiency have been developed and released on the market.

FIG. 1 is a schematic diagram of a related art condensation type clothes dryer to which a heat pump cycle is applicable. Referring to FIG. 1, a condensation type clothes dryer may include a drum 1 in which laundry to be dried may be placed, a circulation duct 2 configured to provide a passage to circulate air through the drum 1, a circulation fan 3 configured to circulate air along the circulation duct 2, and a heat pump cycle 4 having an evaporator 5 and a condenser 6 installed in series in or at the circulation duct 2 to circulate the air along the circulation duct 2. The heat pump cycle 4 may include a circulation pipe that forms a circulation passage to circulate refrigerant through the evaporator 5 and the condenser 6, and a compressor 7 and an expansion valve 8 installed on the circulation pipe between the evaporator 5 and the condenser 6.

The heat pump cycle 4 having the foregoing configuration may transfer thermal energy of air that has passed through the drum 1 via the evaporator 5 to a refrigerant, and then may transfer thermal energy contained in the refrigerant to air introduced into the drum 1 through the condenser 6. As a result, thermal energy wasted in the related art exhaust type clothes dryer or discarded by the related art condensation type clothes dryer may be reused to generate hot air. A heater (not shown) that reheats air heated while passing through the condenser 6 may be additionally included therein. However, the heat pump cycle 4 applied to the related art clothes treating apparatus is unable to perform any role for a long period of time during washing, rinsing, and dehydration cycles prior to a drying cycle, and thus, an effort for using the heat pump cycle 4 prior to the drying cycle is required.

BRIEF DESCRIPTION OF THE DRAWINGS

Embodiments will be described in detail with reference to the following drawings in which like reference numerals refer to like elements, and wherein:

FIGS. 10 and 11 illustrate a flow of air and refrigerant during a washing and dehydration cycle, and FIGS. 12 and 13 illustrate a flow of air and refrigerant during a beginning and end of a drying cycle, and FIGS. 14 and 15 illustrate a flow of air and refrigerant during a middle of the drying cycle;

FIG. 18 is a schematic diagram of the whole clothes treating apparatus, FIG. 19 is a view illustrating that air exhausted from a drum bypasses a first evaporator through a bypass passage and passes through only a condenser, and FIG. 20 is a view illustrating that air exhausted from the drum passes through the first evaporator and the condenser along the circulation duct.

DETAILED DESCRIPTION

Embodiments relate to a clothes treating apparatus capable of using a heat pump cycle even during a washing and dehydration cycle other than a drying cycle. A clothes treating apparatus having a heat pump cycle according an embodiment may focus on dehumidification and drying, which are inherent functions of the heat pump cycle, thereby operating the heat pump cycle for drying during washing and dehydration.

Figure 1:
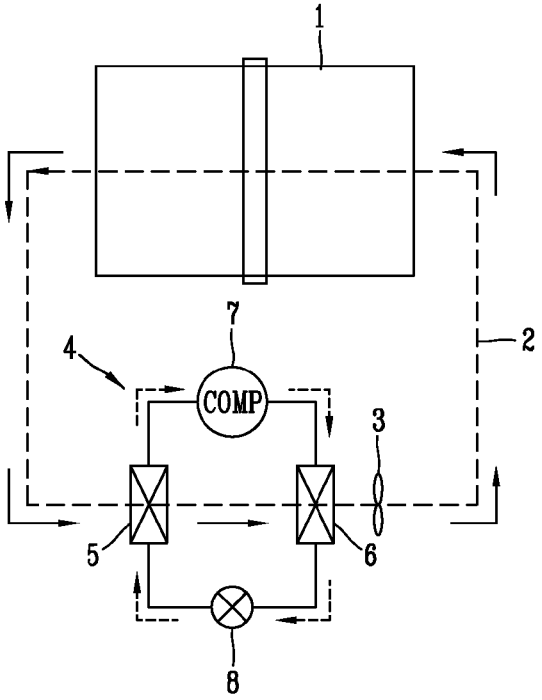
FIG. 1 RELATED ART
FIG. 1 is a schematic diagram of a related art condensing type clothes dryer to which a heat pump cycle is applied.
Figure 2:
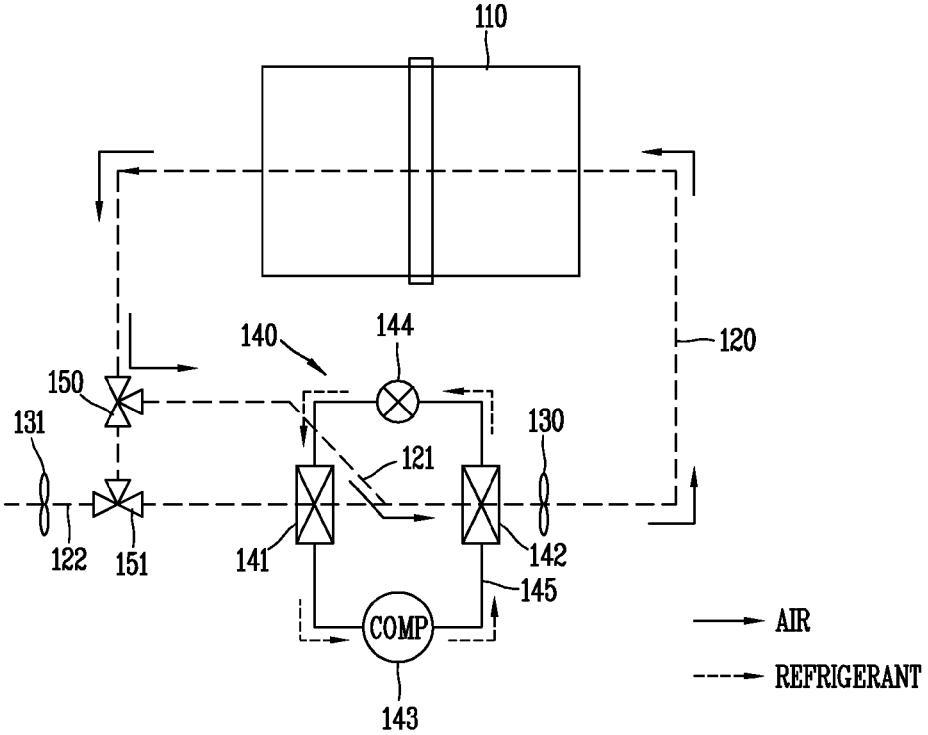
FIG. 2 is a schematic diagram of a clothes treating apparatus having a heat pump cycle according to an embodiment.

FIG. 2 is a schematic diagram of a clothes treating apparatus having a heat pump cycle according to an embodiment. A clothes treating apparatus according to an embodiment may include a case, a drum 110, a circulation duct 120, a circulation fan 130, a heat pump cycle 140, and a controller 170 (see FIG. 4A). The case may form an external appearance of the clothes treating apparatus, and a user input, and a display, for example, may be provided at an upper end portion of the case, thereby allowing a user to select a mode having various functions during washing through the user input, and notifying a user of a current status through the display.

An item or items to be washed and dried, such as laundry, may be accommodated in the drum 110. The drum 110 may have a cylindrical shape having an accommodation space to accommodate the laundry. The drum 110 may be rotatably installed within the case. A front portion of the drum 110 may be open, an opening may be formed on a front portion of the case, and the laundry may be accommodated in the drum 110 through the opening in the case and the front portion of the drum 110. The drum 110 may be installed such that a central axis of rotation thereof may extend horizontally within the case. The drum 110 may be driven by a drive motor installed at a lower portion of the case. An output shaft of the drive motor and an outer circumferential surface of the drum 110 may be connected to each other through a belt, and a rotational force of the drive motor may be transferred to the drum 110 through the belt to rotate the drum 110. The laundry may be dried by circulating heated air through the drum 110.

The heated air may circulate along the circulation duct 120. The circulation duct 120 may form a circulation passage to circulate air through the drum 110. At least a portion of the circulation duct 120 may be connected to an outlet formed at a front side of the drum 110 in a communicating manner to introduce air coming out of the outlet of the drum 110 into the circulation duct 120. Further, at least another portion of the circulation duct 120 may be connected to an inlet formed at a rear side of the drum 110 to supply the air of the circulation duct 120 to the inlet of the drum 110.

The air in the circulation duct 120 may be circulated by the circulation fan 130 to move along the circulation duct 120. One or more circulation fans 130 may be installed within the circulation duct 120. As the one or more circulation fan 130 is operated, the air in the circulation duct 120 may be introduced into the inlet of the drum 110, and the air that has passed through the drum 110 may move along the circulation duct 120 to circulate to the inlet of the drum 110 again. The one or more circulation fan 130 may be connected to the drive motor, and may be driven by receiving power from the drive motor.

The heat pump cycle 140 may include an evaporator 141, a compressor 143, a condenser 142, and an expansion valve 144. The heat pump cycle 140 may perform a function of carrying heat of a low temperature portion to a high temperature portion as the low temperature portion absorbs heat and dissipates the heat to the high temperature portion. The evaporator 141 may be provided at the low temperature portion to absorb heat from the low temperature portion through the evaporator 141, and the condenser 142 may be provided at the high temperature portion to dissipate heat from the condenser 142. For example, the evaporator 141 may be provided within the circulation duct 120 and be connected to an outlet side of the drum 110. The condenser 142 may be provided within the circulation duct 120 and be connected to an inlet side of the drum 110. The evaporator 141 and the condenser 142 may be provided within the circulation duct 120 to be separated from each other; the evaporator 141 may be installed at an upstream side of the circulation duct 120, and the condenser 142 may be installed at a downstream side of the circulation duct 120 based on a moving direction of the air.

Considering a moving path of air along the circulation duct 120, when the one or more circulation fan 130 is activated, heated and dried air in the circulation duct 120 may be introduced into the inlet of the drum 110 to dry laundry accommodated in the drum 110, and then humid air coming out of the drum 110 may be passed through the evaporator 141 and then passed through the condenser 142 to circulate to the drum 110 again. At this time, heat may be removed from air (air temperature may be about 40° C.) coming out of the drum 110, and the air may be heated in the condenser 142 and then reintroduced into the drum 110. Air that has passed through the drum 110 may be cooled, condensed, and dehumidified by the evaporator 141. Then, air that has passed through the evaporator 141 may be heated by the condenser 142.

One or more of the evaporator 141 may be provided within the circulation duct 120. The heat pump cycle 140 illustrated in FIG. 2 may include one evaporator 141 provided on or in the circulation duct 120. When a plurality of evaporators are provided, for example, two evaporators, the plurality of evaporators may include a first evaporator 141 and a second evaporator. The evaporator illustrated in FIG. 2 may be defined as the first evaporator 141. According to embodiments disclosed herein, the evaporator 141 may be provided at an inside of the circulation duct 120, and the second evaporator may be provided at an outside of the circulation duct 120.

The evaporator illustrated in FIG. 2 may be provided at the inside of the circulation duct 120. The evaporator 141 may be one of various types, such as a plate type, a printed board type, and a fin & tube type, for example. The evaporator 141 illustrated in FIG. 2 may be a fin & tube type heat exchanger.

The fin & tube type heat exchanger may include a plurality of heat exchange fins formed in a plate shape and a plurality of heat exchange pipes that pass through the plurality of heat exchange fins in a horizontal direction. The plurality of heat exchange pipes may be connected by connecting pipes bent in a semi-circular shape, and a working fluid may move along an inner portion of the plurality of heat exchange pipes. The plurality of heat exchange fins may extend vertically within the circulation duct 120, and may to be separated from each other in a direction that crosses the air moving direction. Due to this, air coming out of the drum 110 may pass through an air passage between the plurality of heat exchange fins and be brought into contact with the plurality of heat exchange fins and the plurality of heat exchange pipes to exchange heat with the working fluid. The plurality of heat exchange fins may be connected to the plurality of heat exchange pipes to enlarge a contact area of air with the plurality of heat exchange pipes. According to embodiments disclosed herein, the term "working fluid" may refer to a refrigerant.

The condenser 142 may be a fin & tube type heat exchanger as described above, and thus, repetitive description thereof has been omitted. However, heat of air that has passed through the drum 110 may be transferred and absorbed by the refrigerant of the evaporator 141 in the evaporator 141, and heat of a refrigerant of the condenser 142 may be transferred and dissipated to air that has passed through the evaporator 141 in the condenser 142. The evaporator 141, the compressor 143, the condenser 142, and the expansion valve 144 may be connected by a circulation pipe 145. The circulation pipe 145 may form a closed loop.

Considering a moving path of refrigerant flowing along the circulation pipe 145, the refrigerant may pass through the evaporator 141, the compressor 143, the condenser 142, and the expansion valve 144, and then may be circulated to the evaporator 141 again. As the evaporator 141 absorbs heat from air that has passed through the drum 110 and transfers it to the refrigerant of the plurality of heat exchange pipes, low-temperature, low-pressure liquid phase refrigerant introduced into the evaporator 141 may be converted to low-temperature, low-pressure gas phase refrigerant. Air that has passed through the evaporator 141, by latent heat of vaporization according to a phase change of refrigerant in the evaporator 141, may be cooled, condensed, and dehumidified.

The low-temperature, low-pressure gas phase refrigerant exhausted from the evaporator 141 may be moved along the circulation pipe 145 and introduced into the compressor 143. The compressor 143 may compress the low-temperature, low-pressure gas phase refrigerant to make high-temperature, high-pressure gas phase refrigerant. Due to this, it may be possible to dissipate heat absorbed by the low temperature portion from the high temperature portion.

The high-temperature, high-pressure gas phase refrigerant exhausted from the compressor 143 may be moved along the circulation pipe 145 and introduced into the condenser 142. As the condenser 142 transfers and dissipates heat from the high-temperature, high-pressure gas phase refrigerant to air coming out of the evaporator 141, the high-temperature, high-pressure gas phase refrigerant may be converted to high-temperature, high-pressure liquid phase refrigerant. Latent heat of condensation according to a phase change of refrigerant in the condenser 142 may be used to heat air passing through the condenser 142.

The high-temperature, high-pressure liquid phase refrigerant exhausted from the condenser 142 may be moved along the circulation pipe 145 and introduced into the expansion valve 144. The expansion valve 144 may expand the high-temperature, high-pressure liquid phase refrigerant to make low-temperature, low-pressure liquid phase refrigerant. Due to this, it may be possible to absorb heat from air that has passed through the drum 110. Though the heat pump cycle 140 illustrated in FIG. 2 may include one expansion valve 144, a plurality of expansion valves may also be provided, which may include a first expansion valve and a second expansion valve according to an embodiment, and the expansion valve 144 shown in FIG. 2 may be defined as the first expansion valve.

The low-temperature, low-pressure liquid phase refrigerant exhausted from the first expansion valve 144 may be moved along the circulation pipe 145 and introduced into the evaporator 141 again. At this time, the low-temperature, low-pressure refrigerant may be converted into low-temperature, low-pressure gas phase refrigerant while moving along the circulation pipe 145, and the low-temperature, low-pressure refrigerant may be introduced in a state of the liquid phase and gas phase being mixed with each other.

As the passage of air that has passed through the drum 110 during the washing and dehydration cycle other than the drying cycle is switched, the heat pump cycle 140 according to an embodiment may introduce water into the condenser 142 to make hot water and perform additional washing or rinsing using only a heating effect. Further, air heated prior to the drying cycle using only a heating effect of the condenser 142 may be circulated to preheat the drum 110, and the circulation duct 120, for example, to increase a temperature of the drum 110 and the circulation duct 120, for example, thereby performing dehumidification and drying at a fast speed when entering an actual drying cycle as well as effectively reducing a drying time.

For example, when air that has passed through the drum 110 is passed through the evaporator 141 and the condenser 142 as in the existing drying cycle, the air that has passed through the drum 110 may be cooled down while a heat capacity is removed by the evaporator 141, and the cooled air may be heated while passing through the condenser 142. However, it is very inefficient to move heated air along the drum 110 and the circulation duct 120 to preheat the drum 110 and the circulation duct 120. This is because more heat capacity is required to heat air cooled in the evaporator 141 than is required to heat air bypassed without passing through the evaporator 141. Accordingly, embodiments disclosed herein may allow air exhausted from the drum 110 during the washing and dehydration cycle to be introduced into the condenser 142 while bypassing the evaporator 141 to effectively use heat capacity dissipated from the condenser 142, thereby allowing air that has passed through the drum 110 to be introduced and heated in the condenser 142 without being cooled by the evaporator 141 to maximize a heating effect of the condenser 142. To this end, the circulation duct 120 illustrated in FIG. 2 may include a bypass passage 121 to allow air exhausted from the drum 110 to be introduced into the condenser 142 while bypassing the evaporator 141.

Figure 3:
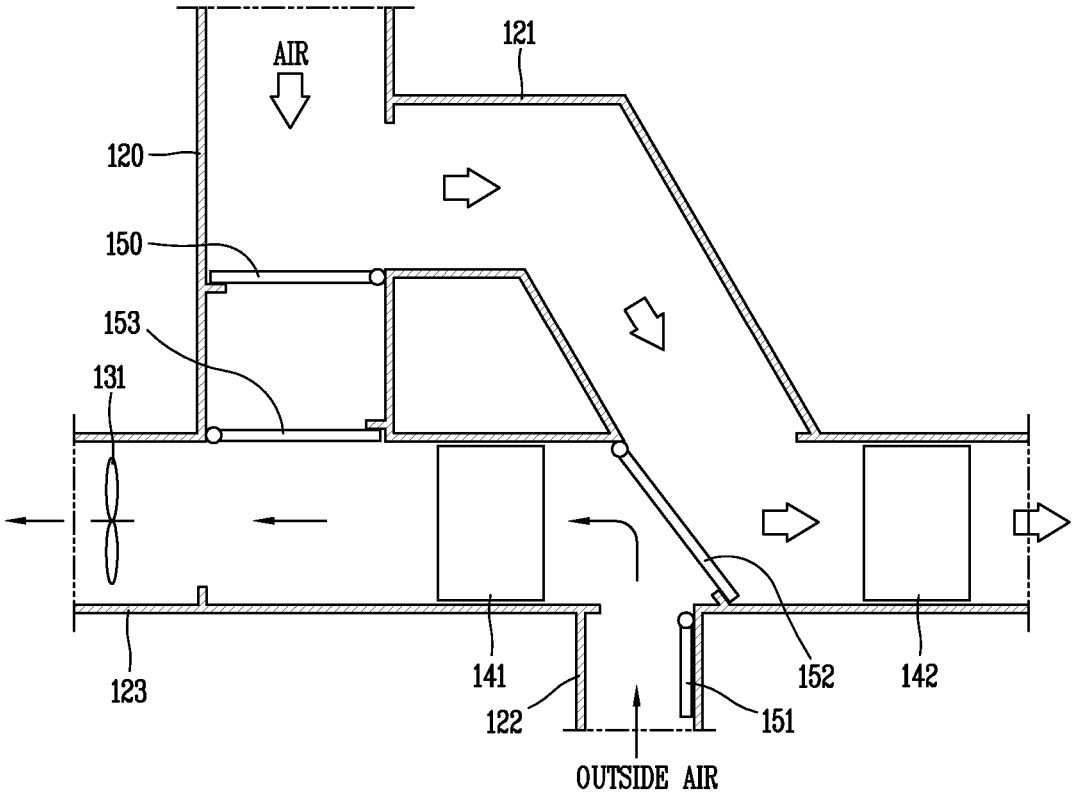
FIG. 3 is a schematic diagram illustrating a flow of air through a bypass passage during a washing and dehydration cycle according to an embodiment.

FIG. 3 is a schematic diagram illustrating a flow of air through a bypass passage during a washing and dehydration cycle according to an embodiment. A first side of a bypass passage 121 may be formed in a branched manner on a first section of the circulation duct 120; namely, a section between the outlet of the drum 110 and an upstream side of the evaporator 141, thereby allowing air exhausted from the drum 110 to be introduced into the bypass passage 121. A second side of the bypass passage 121 may be formed in a communicating manner on a second section of the circulation duct 120, namely, a section between an outlet of the evaporator 141 and an upstream side of the condenser 142, thereby allowing air exhausted from the drum 110 to be introduced into the upstream side of the condenser 142.

As a result, air introduced into the upstream side of the condenser 142 through the bypass passage 121 may be heated by the condenser 142 while passing through the condenser 142. Air introduced through the bypass passage 121 may be heated by the condenser 142 without being dehumidified by the evaporator 141, thereby using only a heating effect of the condenser 142.

A first damper 150 and a second damper 152 may be rotatably provided at a first side and a second side of the bypass passage 121, respectively, as illustrated in FIG. 3. The first damper 150 may be provided at the first side of the bypass passage 121 and may selectively open and close a passage of the circulation duct 120 or an inlet of the bypass passage 121. For example, the first damper 150 may be rotatably coupled to a passage side of the circulation duct 120 to close a passage of the circulation duct 120 and open the inlet of the bypass passage 121. The second damper 152 may be provided at the second side of the bypass passage 121 and may selectively open and close a passage of the circulation duct 120 or an outlet of the bypass passage 121. For example, the second damper 152 may be rotatably coupled to a passage side of the circulation duct 120 to close a passage of the circulation duct 120 and open the outlet of the bypass passage 121. As the inlet and outlet of the bypass passage 121 may be opened by the first damper 150 and the second damper 152 during the washing and dehydration cycle as described above, air exhausted from the drum 110 may bypass the evaporator 141 through the bypass passage 121 to be introduced into the condenser 142 and heated by the condenser 142.

Further, a partial section of the circulation duct 120 illustrated in FIG. 3 may be exposed to outside air. Outside air may include both external air of the case and external air introduced into the case, and may be differentiated from circulation air moving along a closed loop of the circulation duct 120.

The term "partial section of the circulation duct 120" may refer to at least a portion of the circulation duct 120 that connects the outlet of the drum 110 to an inlet of the evaporator 141, and an exhaust port 123 may be provided at a first side of the partial section of the circulation duct 120, and an intake port 122 may be provided at a second side of the partial section of the circulation duct 120. As an intake fan 131 may be provided in the exhaust port 123, outside air may be introduced into the partial section of the circulation duct 120 through the intake port 122. The outside air introduced through the intake port 122 may pass through the evaporator 141 and be exhausted through the exhaust port 123 within the partial section of the circulation duct 120. The intake port 122 may be provided at a location adjacent to the inlet of the evaporator 141, and open in a first direction at one side of the circulation duct 120. The exhaust port 123 may be provided at a location bent toward the evaporator 141 from the intake port 22, and be formed to be open in a lateral direction at a first side of the circulation duct 120. The intake fan 131 may be provided at one side of the exhaust port 123 to introduce outside air into the partial section of the circulation duct 120 through the intake port 122. Locations of the intake port 122 and exhaust port 123 may be exchanged with each other or the intake fan 131 may also be provided in the intake port 122.

A third damper 151 may be rotatably provided in the intake port 122 to open and close the intake port 122, and a fourth damper 153 may be rotatably provided in the exhaust port 123 to open and close the exhaust port 123. As the partial section of the circulation duct 120 may communicate with outside air during the washing and dehydration cycle to allow the outside air to pass through the evaporator 141, heat dispersed in the outside air may be collected by the heat pump cycle 140, and then dissipated through the condenser 142 during the washing and dehydration cycle prior to the drying cycle to preheat the drum 110 and circulation duct 120, for example.

Figure 4:
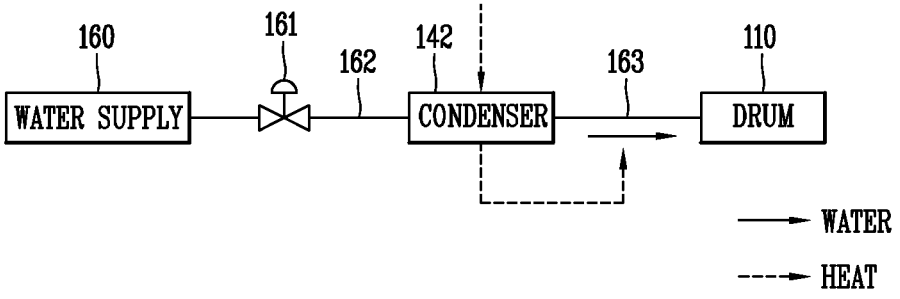
FIG. 4 is a block diagram illustrating a configuration for making hot water using heat dissipated through a condenser according to an embodiment.

FIG. 4 is a block diagram illustrating a configuration for making hot water using heat dissipated through a condenser according to an embodiment. In order to use a heating effect of the condenser 142, this embodiment may include a water supply 160 that supplies water, and the condenser 142 that dissipates a heat capacity to be obtained by the heat pump cycle 140 to water supplied to the drum 110.

The water supply 160 may be a water tap provided at an end of a tap water pipe to supply water to a washer, or a washer dryer, for example. A water supply pipe 162 may be connected between the water supply 160 and the condenser 142 to introduce the water of the water supply 160 to the condenser 142 along the water supply pipe 162.

The condenser 142 may further include a hot water pipe that heats water supplied from the water supply 160, as well as an air passage provided between the plurality of heat exchange fins to allow circulation air or outside air to pass therethrough, and a heat exchange pipe provided within the condenser 142 to exchange heat with air according to a flow of refrigerant. The hot water pipe may be connected to the water supply pipe 162, and thus, heat may be transferred to the water from the refrigerant as the water of the water supply pipe 162 exchanges heat with the refrigerant of the condenser 142 while moving along the hot water pipe, thereby heating the supplied water.

A water supply valve 161 may be provided on the water supply pipe 162 to open and close the water supply pipe 162, and control a flow rate. Further, a hot water pipe outlet of the condenser 142 may be connected to the drum 110 by a connecting pipe 163, and thus, water heated in the condenser 142 may be used for additional washing or rinsing. As described above, a temperature of moisture contained in laundry (also, referred to as "clothes" or "clothing") may be increased during an actual dehydration process to decrease a coupling force between water particles, thereby doubling a dehydration effect.

Figure 4A:
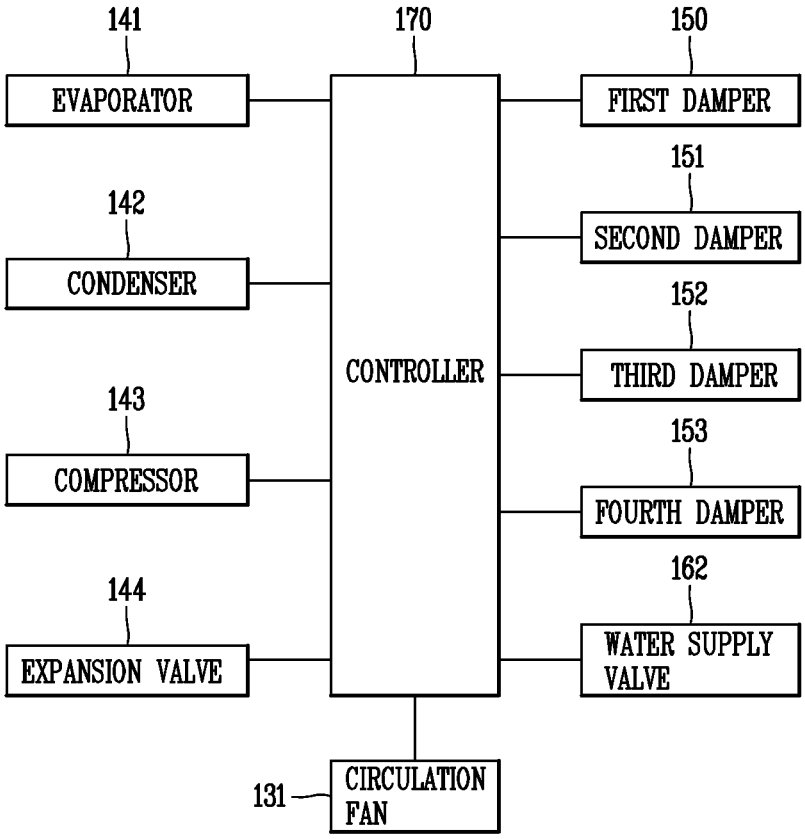
FIG. 4A is a block diagram of a control apparatus for controlling a clothes treating apparatus according to an embodiment.

FIG. 4A is a block diagram of a control apparatus for controlling a clothes treating apparatus according to an embodiment. As shown in FIG. 4A, a control apparatus for controlling a clothes treating apparatus according to an embodiment may include controller 170 in communication with each of the components of the clothes treating apparatus. The controller 170 may send a control signal to each of the components of the clothes treating apparatus to control operation of each component.

Figure 5:
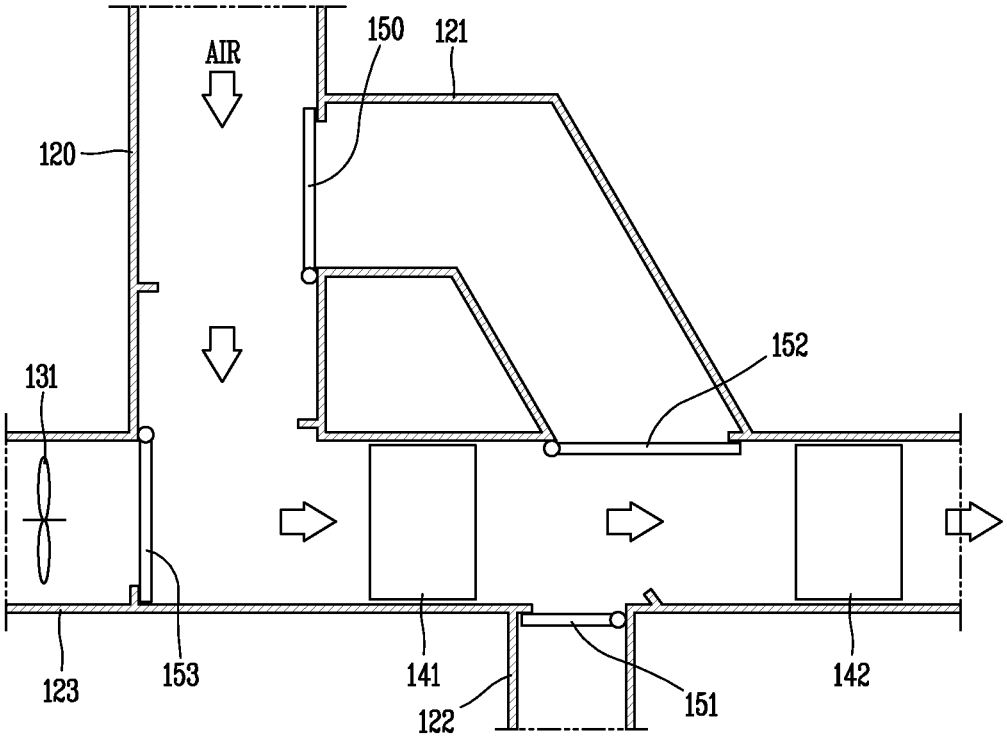
FIG. 5 is a schematic diagram of a flow of air along the circulation duct during a drying cycle according to another embodiment.

FIG. 5 is a schematic diagram of a flow of air along the circulation duct during a drying cycle according to an embodiment. During the drying cycle, the first damper 150 and second damper 152 may be controlled by a control signal received from the controller 170. For example, the first damper 150 and second damper 152 may be rotated to the side of the inlet and the outlet of the bypass passage 121 to close the bypass passage 121 and open the circulation duct 120. The third damper 151 and fourth damper 153 may receive a control signal from the controller 170 to close the intake port 122 and the exhaust port 123, respectively, and open the circulation duct 120. The first damper 150 through the fourth damper 153 may be operated, respectively, by an actuator, such as a motor, for example. Thus, air exhausted from the drum 110 may move along the circulation duct 120, and sequentially pass through the evaporator 141 and the condenser 142, to be dehumidified, heated, and introduced into the drum 110.

According to an embodiment, a passage may be switched to allow air that has passed through the drum 110 to bypass the evaporator 141 and pass through only the condenser 142 and preheat air that has passed through the drum 110 using the dissipated heat capacity of the condenser 142 during the washing and rinsing cycle other than the drying cycle in which a dehumidification capacity is allowed to be low, thereby performing dehumidification and drying at a fast speed when entering an actual drying cycle to effectively reduce a drying time.

Further, a passage may be changed to allow the evaporator 141 to be brought into contact with outside air in the partial section of the circulation duct 120, and a heat capacity of the outside air may be collected by the evaporator 141 and dissipated to the condenser 142 to circulate air, thereby preheating at least one of the drum 110 or the circulation duct 120.

Water supplied to the clothes treating apparatus may flow to the condenser 142 to heat water using a heat capacity of the condenser 142, thereby additionally using the heated water as washing and rinsing water. Further, the heat pump cycle 140 may be operated prior to the drying cycle to circulate air through the evaporator 141, the compressor 143, the condenser 142, and the first expansion valve 144, via the circulation pipe 145, thereby reducing a time required to preheat the evaporator 141 and the condenser 142, for example, when entering an actual drying cycle.

Figure 6:
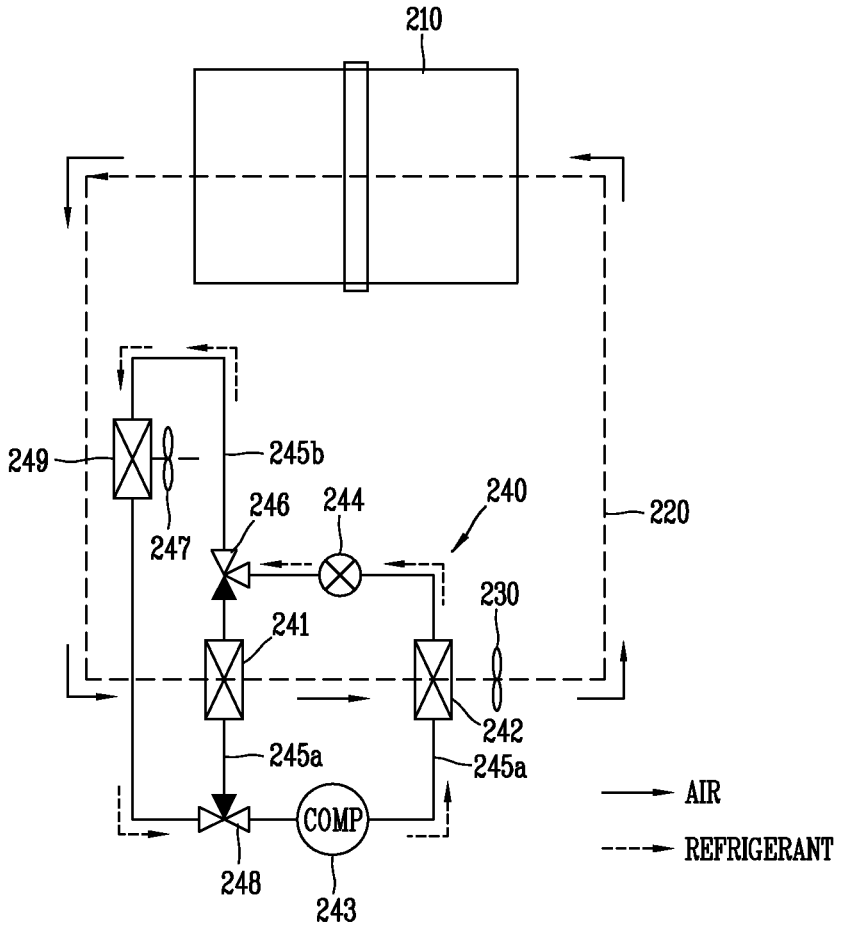
FIG. 6 is a schematic diagram of a clothes treating apparatus having a heat pump cycle according to another embodiment.

FIG. 6 is a schematic diagram of a clothes treating apparatus having a heat pump cycle according to another embodiment. The heat pump cycle 240 illustrated in FIG. 6 may further include a second evaporator 249, and a first three-way valve 246 and a second three-way valve 248 connected in parallel. A control apparatus for controlling a clothes treating apparatus according to this embodiment may include controller 270 in communication with each of the components of the clothes treating apparatus. The controller 270 may send a control signal to each of the components of the clothes treating apparatus to control operation of each component. Redundant description of similar or the same components as the previous embodiment has been omitted.

First evaporator 241 may be provided within circulation duct 220, and air coming out of drum 210 may pass through the first evaporator 241. However, the second evaporator 249 may be provided at an outside of the circulation duct 220, and be configured to be brought into contact with outside air. For example, an intake port may be provided at a first lateral surface of the second evaporator 249 to introduce outside air through the intake port. Further, an exhaust port may be provided at a second lateral surface of the second evaporator 249 to exhaust outside air through the exhaust port.

An intake fan 247 may be provided at or in at least one of the intake port or the exhaust port of the second evaporator 249 to blow outside air to the second evaporator 249. The intake fan 247 may be driven by an actuator, such as a motor, for example. The controller 270 may control operation of the actuator driving the intake fan 247 to control an on/off of the intake fan 247.

The first evaporator 241 may be connected to compressor 243 and first expansion valve 244 by first circulation pipe 245*a*, and the second evaporator 249 may be connected to the compressor 243 and the first expansion valve 244 by second circulation pipe 245*b*. The first evaporator 241 and the second evaporator 249 may be connected in parallel by the second circulation pipe 245*b*.

The first three-way valve 246 and the second three-way valve 248 may be installed at a first side and a second side, respectively, of a portion at which the first circulation pipe 245*a* is connected to the second circulation pipe 245*b* to selectively open the first circulation pipe 245*a* and the second circulation pipe 245*b*. FIG. 6 illustrates a moving path of refrigerant during the washing and dehydration cycle. For example, the first three-way valve 246 illustrated in FIG. 6 may have a three-way passage, namely, an inlet passage at a side of the first expansion valve 244, an outlet passage at a side of the first evaporator 241, and an outlet passage at a side of the second evaporator 249. The second three-way valve 248 illustrated in FIG. 6 may have a three-way passage, namely, an inlet passage at a side of the second evaporator 249, an inlet passage at a side of the first evaporator 241, and an outlet passage at a side of the compressor 243. As the first three-way valve 246 receives a control signal from the controller 270 during the washing and dehydration cycle, and operates to close the outlet passage at the side of the first evaporator 241 and open the remaining two passages, refrigerant that has passed through the first expansion valve 244 may bypass the first evaporator 241, and may move along the second circulation pipe 245*b* to be introduced into the second evaporator 249. As the second three-way valve 248 receives a control signal from the controller 270 during the washing and dehydration cycle, and operates to close the inlet passage at the side of the first evaporator 241 and open the remaining two passages, refrigerant that has passed through the second evaporator 249 may be introduced into the compressor 243.

In the heat pump cycle 240 illustrated in FIG. 6, refrigerant may bypass the first evaporator 241, and sequentially pass through the second evaporator 249, the compressor 243, the condenser 242, and the first expansion valve 244. Low-temperature, low-pressure liquid phase refrigerant introduced into the second evaporator 249 may exchange heat with outside air introduced through the intake port of the second evaporator 249 to absorb heat of outside air, and may be phase-changed from a liquid phase to a gas phase by the absorbed heat. Outside air that has passed through the second evaporator 249 may be cooled in the second evaporator 249 and then exhausted outside of the second evaporator 249 through the exhaust port. Further, low-temperature, low-pressure gas phase refrigerant evaporated from the second evaporator 249 may be introduced into the compressor 243 to be compressed, and the compressed high-temperature, high-pressure gas phase refrigerant may be introduced into the condenser 242 to exchange heat with air that has passed through the first evaporator 241. Refrigerant may not be introduced into the first evaporator 241, and thus, cooling of air due to the first evaporator 241 may not actually be carried out. Air introduced into the condenser 242 through the first evaporator 241 may exchange heat with the refrigerant of the condenser 242, and thus, the heat of high-temperature, high-pressure gas phase refrigerant may be transferred to the air introduced into the condenser 242, and cooled and condensed. At this time, the high-temperature, high-pressure gas phase refrigerant may be converted to high-temperature, high-pressure liquid phase refrigerant, and latent heat of condensation generated according to the phase change may be used to heat air passing through the condenser 242.

According to the embodiment illustrated in FIG. 6, the first three-way valve 246 and the second three-way valve 248 may be controlled during the washing cycle to allow refrigerant to flow through the second evaporator 249 without flowing through the first evaporator 241, and absorb the heat of outside air through the second evaporator 249 without actually operating the first evaporator 241 and dissipating it through the condenser 242. Thus, the drum 210 and the circulation duct 220, for example, may be preheated during the washing and dehydration cycle prior to the drying cycle, thereby performing dehumidification and drying at a fast speed when entering an actual drying cycle as well as effectively reducing a drying time.

Figure 7:
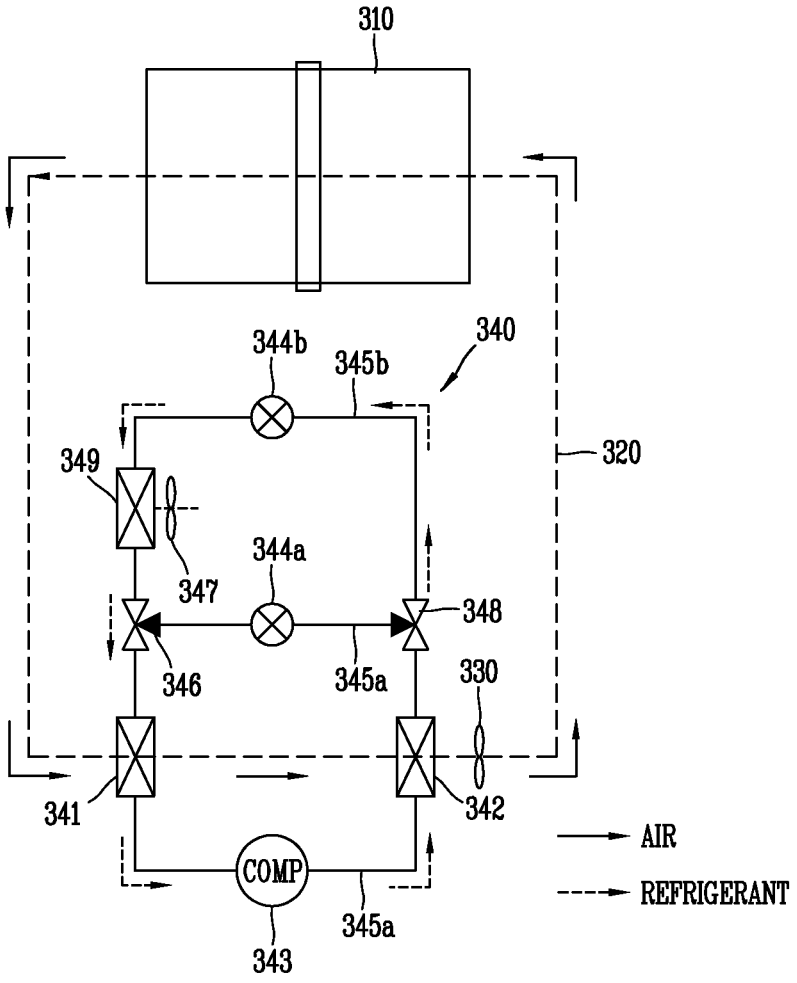
FIG. 7 is a schematic diagram of a clothes treating apparatus having a heat pump cycle according to another embodiment.

FIG. 7 is a schematic diagram of a clothes treating apparatus having a heat pump cycle according to an embodiment. The heat pump cycle 340 illustrated in FIG. 7 may further include a second evaporator 349, a first three-way valve 346, a second three-way valve 348, and a second expansion valve 344*b* connected in series. A control apparatus for controlling a clothes treating apparatus according to this embodiment may include controller 370 in communication with each of the components of the cloths treating apparatus. The controller 370 may send a control signal to each of the components of the clothes treating apparatus to control operation of each component. Redundant description of similar or the same components as the embodiment of FIG. 2 has been omitted.

First evaporator 341 may be provided within circulation duct 320, and air coming out of drum 310 may pass through the first evaporator 341. However, the second evaporator 349 may be provided at an outside of the circulation duct 320, and be configured to be brought into contact with outside air. For example, an intake port may be provided at a first lateral surface of the second evaporator 349 to introduce outside air through the intake port. Further, an exhaust port may be provided at a second lateral surface of the second evaporator 349 to exhaust port outside air through the exhaust.

Intake fan 347 may be provided at or in at least one of the intake port or exhaust port of the second evaporator 349 to blow outside air to the second evaporator 349. The intake fan 347 may be driven by an actuator, such as a motor, for example. The controller 370 may control operation of the actuator driving the intake fan 347 to control an on/off of the intake fan 347.

The first evaporator 341 may be connected to compressor 343 and first expansion valve 344*a* by first circulation pipe 345*a*, and the second evaporator 349 may be connected to the first evaporator 341 and the second expansion valve 344*b* by second circulation pipe 345*b*. The first evaporator 341 and the second evaporator 349 may be connected in series by the first and second circulation pipes 345*a*, 345*b*.

The first three-way valve 346 and the second three-way valve 348 may be provided at a first side and a second side of a portion at which the first circulation pipe 345*a* may be connected to the second circulation pipe 345*b* to selectively open the first circulation pipe 345*a* and second circulation pipe 345*b*. FIG. 7 illustrates a moving path of refrigerant during the washing and dehydration cycle. For example, the first three-way valve 346 illustrated in FIG. 6 may have a three-way passage, namely, an inlet passage at a side of the condenser 342, an outlet passage at a side of the second expansion valve 344*b*, and an outlet passage at a side of the first expansion valve 344*a*. The second three-way valve 348 illustrated in FIG. 7 may have a three-way passage, namely, an inlet passage at a side of the second evaporator 349, an outlet passage at a side of the first evaporator 341, and an inlet passage at a side of the first expansion valve 344*a*. As the first three-way valve 346 receives a control signal from the controller 370, and operates to close the outlet passage at the side of the second expansion valve 344*b* and open the remaining two passages, refrigerant that has passed through the condenser 342 may bypass the first expansion valve 344*a*, and may move along the second circulation pipe 345*b* to be introduced into the second expansion valve 344*b*. As the second three-way valve 348 receives a control signal from the controller 370, and operates to close the outlet passage at the side of the first expansion valve 344*a* and open the remaining two passages, refrigerant that has passed through the second evaporator 349 may be introduced into the compressor 343 through the first evaporator 341.

In the heat pump cycle 340 illustrated in FIG. 7, refrigerant may bypass the first expansion valve 344*a*, and may sequentially pass through the second evaporator 349, the first evaporator 341, the compressor 343, the condenser 342, and the second expansion valve 344*b*. Low-temperature, low-pressure liquid phase refrigerant introduced into the second evaporator 349 may exchange heat with outside air introduced through the intake port of the second evaporator 349 to absorb heat of outside air, and may be phase-changed from a liquid phase to a gas phase by the absorbed heat. Outside air that has passed through the second evaporator 349 may be cooled in the second evaporator 349 and then be exhausted outside of the second evaporator 349 through the exhaust. Further, low-temperature, low-pressure gas phase refrigerant evaporated by the second evaporator 349 may be introduced into the first evaporator 341 to exchange heat with air exhausted from the first evaporator 341 to the drum 310 to secondarily absorb the heat of air. Low-temperature, low-pressure refrigerant coming out of the first evaporator 341 may be introduced into the compressor 343 to be compressed, and the compressed high-temperature, high-pressure gas phase refrigerant may be introduced into the condenser 342 to exchange heat with air that has passed through the first evaporator 341. Refrigerant may be introduced into the second evaporator 349 and the first evaporator 341, and thus, air that has passed through the drum 310 may be dehumidified in the first evaporator 341 and heated in the condenser 342. Air introduced into the condenser 342 through the first evaporator 341 may exchange heat with the refrigerant of the condenser 342, and thus, the heat of high-temperature, high-pressure gas phase refrigerant may be transferred to the air introduced into the condenser 342, and cooled and condensed. At this time, the high-temperature, high-pressure gas phase refrigerant may be converted to high-temperature, high-pressure liquid phase refrigerant, and latent heat of condensation generated according to the phase change may be used to heat air passing through the condenser 342.

According to the embodiment illustrated in FIG. 7, the first three-way valve 346 and the second three-way valve 348 may be controlled during the washing cycle to allow refrigerant to flow through the first evaporator 341 and the second evaporator 349 so as to operate both the first evaporator 341 and the second evaporator 349 and absorb air and the heat of outside air through the first evaporator 341 and the second evaporator 349 and dissipate it through the condenser 342. Thus, the drum 310 and the circulation duct 320, for example, may be preheated during the washing and dehydration cycle prior to the drying cycle, thereby performing dehumidification and drying at a fast speed when entering an actual drying cycle as well as effectively reducing a drying time.

Figure 8:
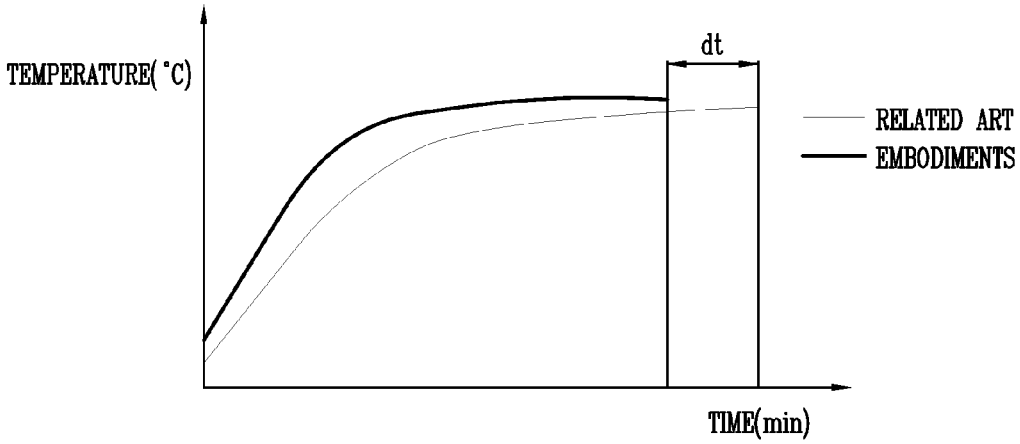
FIG. 8 is a graph illustrating a temperature change according to a drying time in a clothes treating apparatus having a heat pump cycle according to an embodiment.
Figure 9:
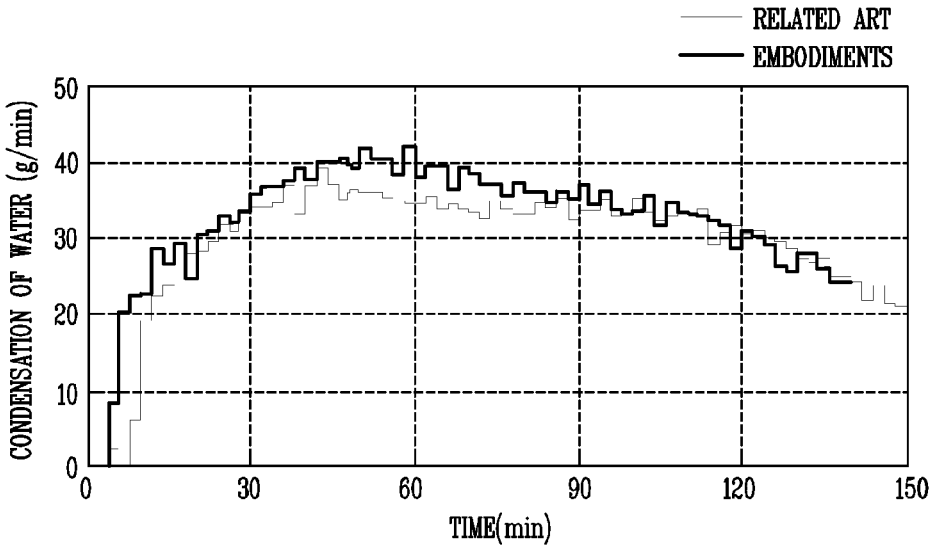
FIG. 9 is a graph illustrating a change of rate of condensate water dehumidified by an evaporator in a clothes treating apparatus having a heat pump cycle according to an embodiment.

FIG. 8 is a graph illustrating a temperature change according to a drying time in a clothes treating apparatus having a heat pump cycle according to an embodiment. FIG. 9 is a graph illustrating a change of rate of condensate water dehumidified by an evaporator in a clothes treating apparatus having a heat pump cycle according to an embodiment.

Referring to FIG. 8, when entering a drying cycle, compared to a case in which the heat pump cycle 340 is initially driven (shown as a thin line), a refrigerant cycle may be warmed up prior to entering the drying cycle, such as in the washing or dehydration cycle, or the drying cycle may be carried out in a state in which the drum and circulation duct are heated in advance (embodiment disclosed herein, shown as a bold line), thereby having an effect of more quickly entering a saturation temperature region for the refrigerant cycle to advance a time point at which maximum capacity is provided as well as reducing a time (dt) required to heat the evaporator, the condenser, the drum, and the circulation duct, for example, within the system to complete the drying cycle within a short period of time. Further, referring to FIG. 9, a result is shown that condensation water may be generated at a fast speed in an evaporator according to an embodiment compared to an evaporator according to the related art to enhance a dehumidification capacity as a whole, and as a result, the drying cycle may be completed at a fast drying speed in a same condition.

Figure 10:
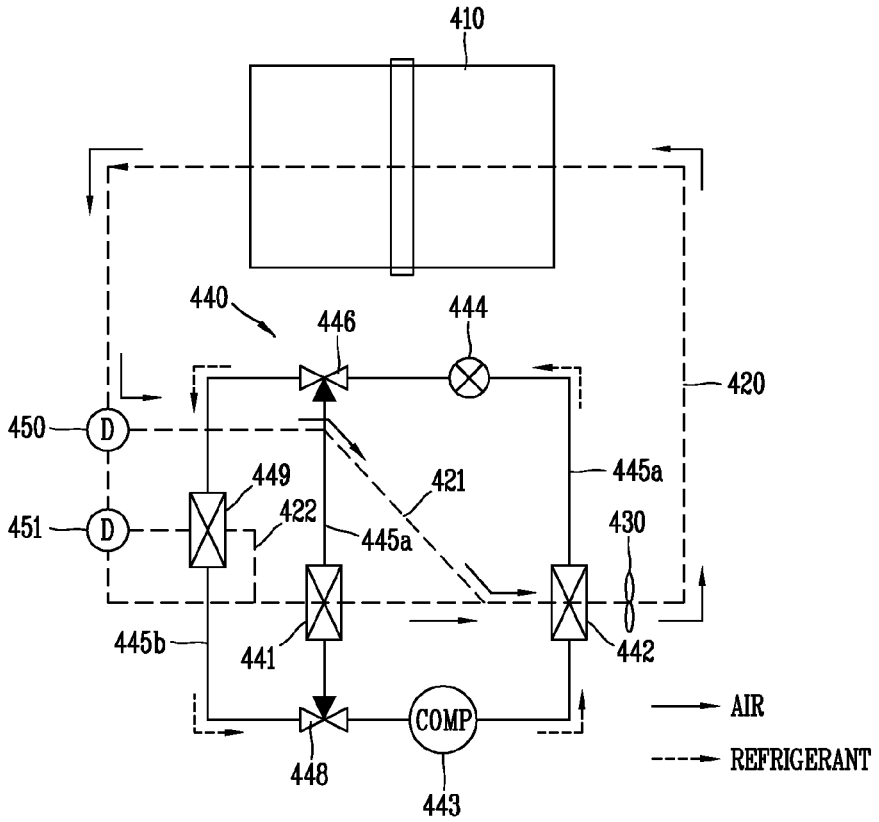
FIGS. 10 through 15 are schematic views illustrating a clothes treating apparatus having a heat pump cycle according to another embodiment, wherein in particular.
Figure 11:
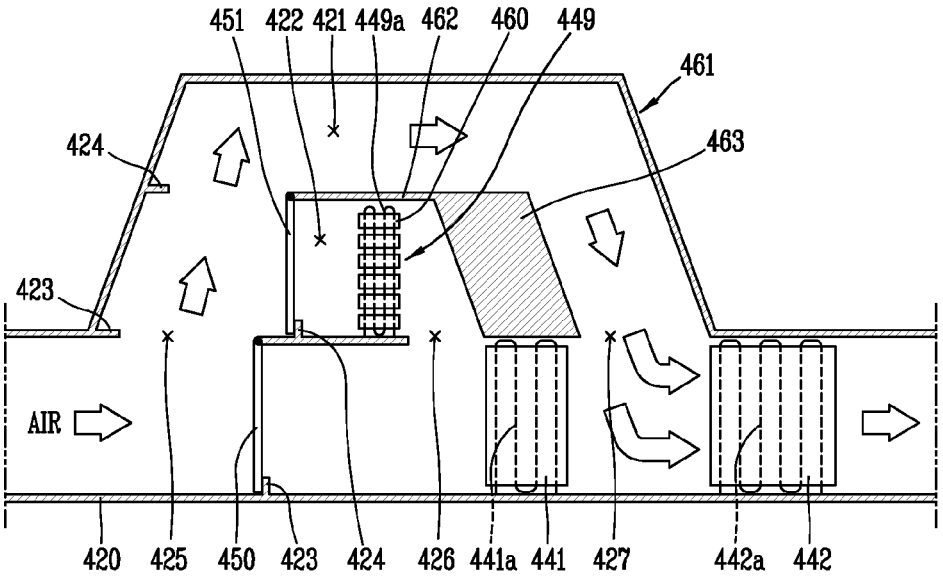
Figure 12:
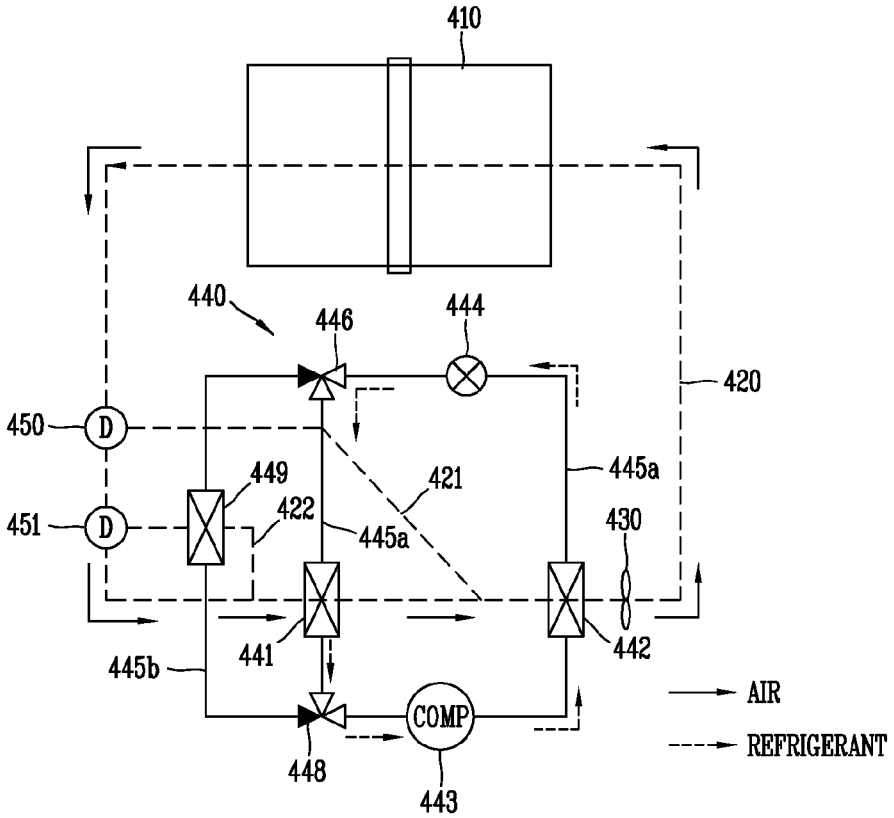
Figure 13:
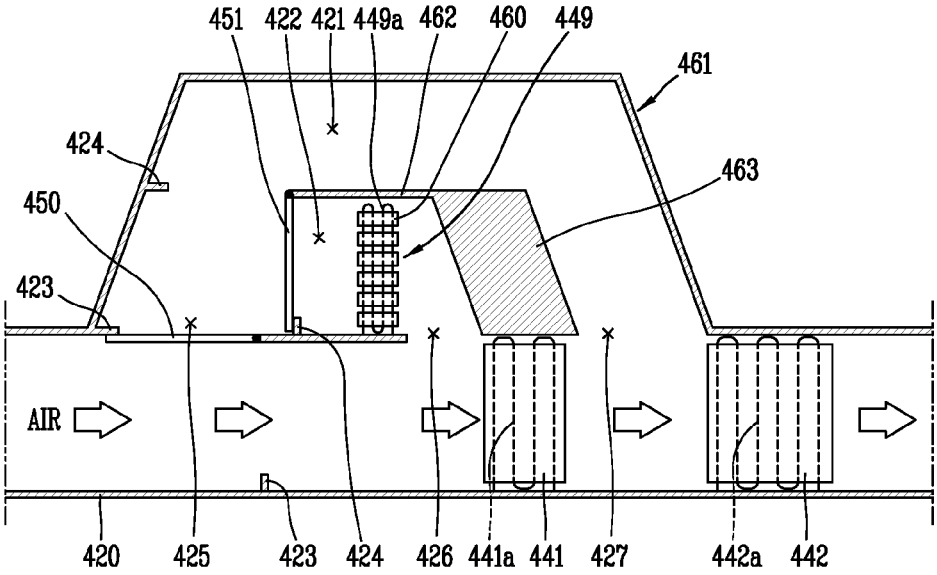
Figure 14:
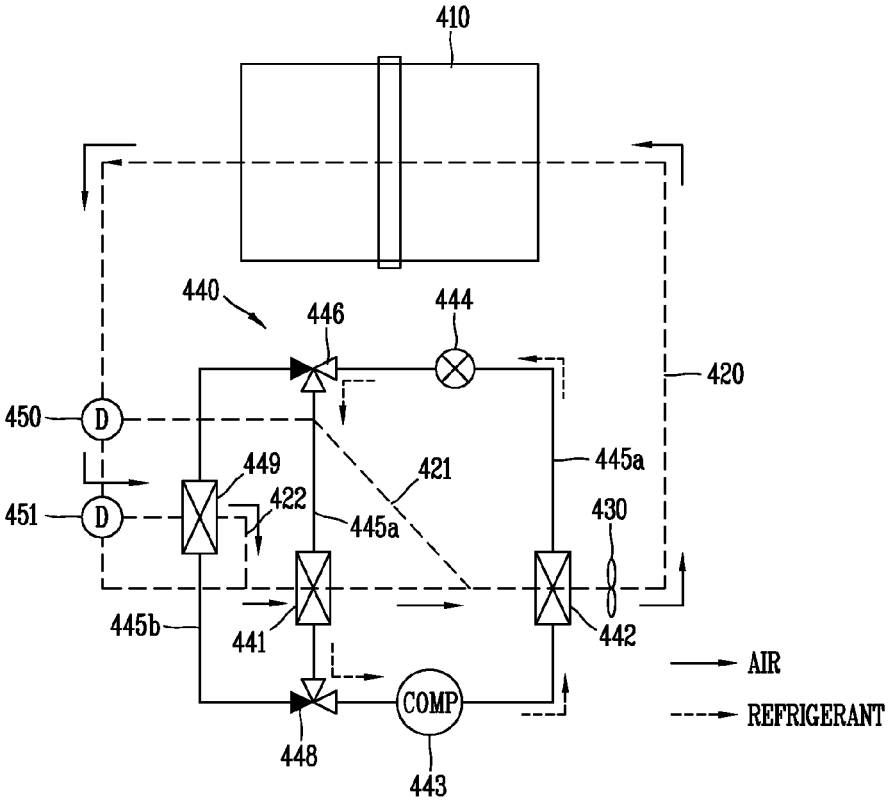
Figure 15:
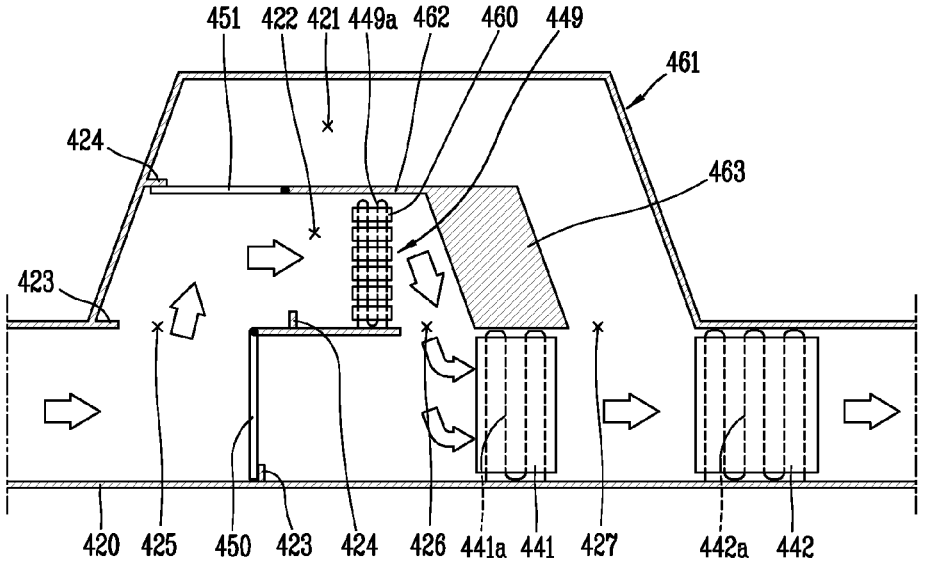

FIGS. 10 through 15 are schematic diagram of a clothes treating apparatus having a heat pump cycle according to another embodiment. In particular, FIGS. 10 and 11 illustrate a flow of air and refrigerant during a washing and dehydration cycle. FIGS. 12 and 13 illustrate a flow of air and refrigerant during a beginning and end of a drying cycle. FIGS. 14 and 15 illustrate a flow of air and refrigerant during a middle of the drying cycle.

Heat pump cycle 440 illustrated in FIG. 10 may by similar to heat pump cycle 240 illustrated in FIG. 6 in that second evaporator 449 may be connected to first evaporator 441 in parallel by second circulation pipe 445. However, the heat pump cycle 440 may include an ice storage block 460, in which an ice storage material may be stored, to perform ice storage and preheating during the washing and dehydration cycle, and as illustrated in FIGS. 14 and 15, the second evaporator 449 may be exposed to heat at a required time point while performing the drying cycle, thereby enhancing a dehumidification capacity or decreasing an evaporating pressure of the first evaporator 441 and a condensing pressure of condenser 442 through precooling to promote stabilization of the heat pump cycle 440.

Drum 410, circulation duct 420, and circulation fan 430, for example, illustrated in FIGS. 10 through 15 may be the same as or similar to the drum 110, the circulation duct 120, and the circulation fan 130, for example, and thus, description thereof has been omitted. Further, the first evaporator 441, the condenser 442, first expansion valve 444, first three-way valve 446, and second three-way valve 448, for example, in the heat pump cycle 440 illustrated in FIGS. 10 through 15 may be the same as or similar to the first evaporator 241, the condenser 242, the first expansion valve 244, the first three-way valve 246, and the second three-way valve 248, for example, and thus, description thereof has been omitted.

The second evaporator 449 may be a block & tube type heat exchanger including a plurality of ice storage blocks 460 and heat exchange pipes 449*a*. An inside of the each of the plurality of ice storage block 460 may be maintained at a proper pressure, and an ice storage material may be stored within each of the plurality of the ice storage block 460. The ice storage material may be a phase change material that may be phase-changed to solid, liquid, and gas. For example, when the ice storage material in a liquid phase is cooled below a freezing point, it may be phase-changed to a solid state to store latent heat of solidification in the ice storage material. The ice storage material may be water, for example, and latent heat corresponding to about 80 kcal may be stored for ice of 1 kg. The plurality of ice storage blocks 460 may be provided separated from each other in a direction crossing the air moving direction to allow air coming out of the drum 410 to pass therethrough to form an air passage between the plurality of ice storage blocks 460.

Refrigerant may flow into the plurality of heat exchange pipes 449*a*, and the plurality of heat exchange pipes 449*a* may be coupled to the plurality of ice storage blocks 460 and pass through the plurality of ice storage blocks 460, thereby allowing the refrigerant of the plurality of heat exchange pipes 449*a* and the ice storage material of the plurality of ice storage blocks 460 to exchange heat with each other. Further, the plurality of heat exchange pipes 449*a* may extend vertically and be separated from each other, and the plurality of heat exchange pipes 449*a* may be connected by a semi-circular shaped connecting pipe. Furthermore, air coming out of the drum 410 may exchange heat with the ice storage material and refrigerant while passing through the plurality of ice storage blocks 460.

A passage change portion 461 may be provided at one side of the circulation duct 420 illustrated in FIGS. 10 through 15. The passage change portion 461 may include a first passage 421 and a second passage 422 that change a moving path of air coming out of the drum 410 during advancement of the washing cycle and the drying cycle. For example, the first passage 421 may be formed on the circulation duct 420 to allow air coming out of the drum 410 during the washing and dehydration cycle to bypass the first evaporator 441 and the second evaporator 449 and pass through the condenser 442.

The second passage 422 may be formed on the circulation duct 420 to allow air coming out of the drum 410 during a middle of the drying cycle to pass through the second evaporator 449, the first evaporator 441, and the condenser 442. The circulation duct 420 may be formed to allow air coming out of the drum 410 during a beginning of the drying cycle and an end of the drying cycle to pass through the first evaporator 441 and the condenser 442.

A first damper 450 may be rotatably provided between an inlet of the first passage 421 and the circulation duct 420 to selectively open and close the first passage 421 and the circulation duct 420. Due to this, air coming out of the drum 410 may flow through the first passage 421 to bypass the first evaporator 441 and the second evaporator 449 and pass through the condenser 442 or flow along the circulation duct 420 to pass through the first evaporator 441 and the condenser 442.

A second damper 451 may be rotatably provided between the first passage 421 and the second passage 422 to selectively open and close the first passage 421 and the second passage 422. Due to this, air coming out of the drum 410 may flow into the first passage 421 or flow through the second passage 422 to pass through the second evaporator 449, the first evaporator 441, and the condenser 442.

Air that has passed through the drum 410 may be introduced into any one of the first passage 421, the second passage 422, or circulation duct 420 by operation of the first damper 450 and the second damper 451, and the first passage 421, the second passage 422, and the circulation duct 420 may be independently formed, respectively, to change the moving path of air. Further, air that has passed through the drum 410 should necessarily pass through the condenser 442 while moving to any one of the first passage 421, the second passage 422, and the circulation duct 420. This may be done to heat air using heat dissipated from the condenser 442 and then supply the heated air to the drum 410.

The passage change portion 461 may be provided at an upper side of the circulation duct 420. A location of the passage change portion 461 on or at a top of the circulation duct 420 may be determined by considering that a temperature of air exhausted from the drum 410 may be about 40° C., and it may be higher than ambient temperatures of 15-25° C., and thus, airflow may be highly likely to be formed at an upper side in a gravitational direction due to its density difference. As a result, the passage change portion 461 may be formed on or at the top of the circulation duct 420. The passage change portion 461 may protrude at the upper side of the circulation duct 420.

The first passage 421 and the second passage 422 may be formed within the passage change portion 461. A first partition 462 may be provided within the passage change portion 461 to be separated from the upper side of the circulation duct 420 to extend in a direction parallel to the air moving direction, and the first passage 421 may be located on or at a top of the passage change portion 461 above the first partition 462, and the second passage 422 may be partitioned to be located at a bottom of the passage change portion 461 below the first partition. Further, a second partition 463 may extend at an incline downward to an upper side of the first evaporator 441 from a rear end of the first partition 462, and an outlet of the first passage 421 and an outlet of the second passage 422 may be separated from each other by the second partition 463.

The first evaporator 441 and the condenser 442 may be separated from each other in an upstream side and a downstream side within the circulation duct 420, and the second evaporator 449 may be provided within the second passage 422. Further, a front end of the passage change portion 461 may be connected to the circulation duct 420 to be separated in the upstream side direction at an inlet of the first evaporator 441, and a rear end of the passage change portion 461 may be connected to the circulation duct 420 to be located directly on or at an inlet of the condenser 442.

Three openings may be formed at a boundary between the bottom of the passage change portion 461 and the top of the circulation duct 420. A first opening 425 may be formed at a boundary between a most front lower end of the passage change portion 461 and the top of the circulation duct 420 based on the air moving direction, and an inlet of the first passage 421 and a portion of the circulation duct 420 may communicate via the first opening 425. Further, a third opening 427 may be formed at a boundary between a most rear lower end of the passage change portion 461 and the top of the circulation duct 420, and the outlet of the first passage 421 may communicate with a portion of the circulation duct 420 via the third opening 427. Furthermore, a second opening 426 may be formed at a boundary between a middle lower portion of the passage change portion 461 and the top of the circulation duct 420, and the outlet of the second passage 422 may communicate with a portion of the circulation duct 420 via the second opening 426. The inlet of the first passage 421 and an inlet of the second passage 422 may share the first opening 425, and the outlet of the first passage 421 may communicate with the inlet (front end) of the first evaporator 441 through the second opening 426, and the outlet of the second passage 422 may communicate with the inlet (front end) of the condenser 442 through the third opening 427. A base length of the second partition 463 may be the same as or similar to a front to rear direction length of the first evaporator 441.

The first damper 450 may be hinge-coupled to a rear end of the inlet of the first passage 421 to rotate in a vertical direction, and first stoppers 423 may be formed at upper and lower sides of the circulation duct 420, respectively, to limit a rotational angle of the first damper 450 to a predetermined range. For example, the rotational angle of the first damper 450 may be limited to about 90 degrees, and a circulation passage at the side of the first evaporator 441 may be closed when the first damper 450 rotates in a downward vertical direction, and the inlet of the first passage 421 may be closed when the first damper 450 rotates in an upward horizontal direction.

The second damper 451 may be hinge-coupled to a front end of the inlet of the second passage 422 to rotate in a vertical direction, and second stoppers 424 may be formed at a bottom of the inlet of the second passage 422 and the inlet of the first passage 421, respectively, to limit a rotational angle of the second damper 451 to a predetermined range. For example, the rotational angle of the second damper 451 may be limited to about 90 degrees, and the second passage 422 at the side of the second evaporator 449 may be closed when the second damper 451 rotates in a downward vertical direction, and the first passage 421 may be closed when the second damper 451 rotates in an upward horizontal direction. The second damper 451 may be located at a top of the first damper 450, and they may operate in a manner independent from each other. The first damper 450 and the second damper 451 may be activated by an actuator, such as a motor, or a solenoid, for example. A controller 470 (see FIG. 16) may control operation of the actuator to control operation of the first damper 450 and the second damper 451.

A method for controlling a clothes treating apparatus having a heat pump cycle having the foregoing configuration will be described hereinafter. Treatment of laundry, such as clothes, may be carried out in washing (including rinsing), dehydration, and drying cycles, for example, and a method for controlling a clothes treating apparatus according to an embodiment will be described in a sequence of the foregoing cycles.

Referring to FIGS. 10 and 11, ice storage may be carried out through the second evaporator 449 during the washing and dehydration cycle, and air that has passed through the drum 410 may bypass the first evaporator 441 and the second evaporator 449 and pass through only the condenser 442, thereby preheating the heat pump cycle 440, for example, that is, the evaporators 441, 449, the condenser 442, the drum 410, and the circulation duct 420, prior to the drying cycle using only a heating effect of the condenser 442. An operation state of a product may be checked by checking whether a power button, or an input button according to an operation mode, for example, has been pressed by a user.

When the operation state is a washing and dehydration cycle, the controller 470 may send a control signal to the circulation fan 430 to activate the circulation fan 430. Further, the first three-way valve 446 and the second three-way valve 448 of the heat pump cycle 440 may be controlled by receiving a control signal from the controller 470, and refrigerant may bypass the first evaporator 441 and pass through the second evaporator 449 to circulate through the compressor 443, the condenser 442, and the first expansion valve 444. This may be done to perform ice storage by the second evaporator 449 and preheating using a heating effect of the condenser 442.

The air moving path and operation of the heat pump cycle 440 will be described hereinafter. When the circulation fan 430 is activated during the washing and dehydration cycle, the air in the circulation duct 420 may be introduced into the inlet of the drum 410 by the circulation fan 430, and air exhausted from the drum 410 may bypass the first evaporator 441 and the second evaporator 449 through the first passage 421 and pass through the condenser 442. The first damper 450 may rotate downward to close the inlet of the first evaporator 441 and open the first passage 421. The second damper 451 may rotate downward to close the second passage 422 and the inlet of the second evaporator 449. At this time, refrigerant may not be supplied to the first evaporator 441, and air exhausted from the drum 410 may not pass through the first evaporator 441, and thus, moisture in the air may not be removed by the first evaporator 441. However, air that has passed through the drum 410 may be heated by the condenser 442. The air heated by the condenser 442 may be circulated to the inlet of the drum 410 again to heat the drum 410 and the circulation duct 420.

The refrigerant moving path and operation of the heat pump cycle 440 will be described hereinafter. When the compressor 443 is activated, refrigerant in the circulation duct 420 may be introduced into the second evaporator 449, and an ice storage material in a liquid phase stored in the plurality of ice storage block 460 in the second evaporator 449 may exchange heat with refrigerant flowing along the heat exchange pipe 449*a* of the second evaporator 449, which allows the refrigerant to absorb heat from the ice storage material and cool the ice storage material. Low-temperature, low-pressure gas phase refrigerant coming out of the second evaporator 449 may be introduced into the compressor 443 and compressed to generate high-temperature, high-pressure gas phase refrigerant. The high-temperature, high-pressure gas phase refrigerant may be transferred to the condenser 442, and the heat of the refrigerant may be dissipated to air passing through the condenser 442. The high-temperature, high-pressure refrigerant may be phase-changed to a liquid phase in the condenser 442 to generate latent heat of condensation while being condensed, and the latent heat of condensation may be used to heat the air passing through the condenser 442. Further, a heat capacity dissipated from the condenser 442 may be used to heat water supplied to the condenser 442 by a water supply pipe. The heated water may be directly supplied to the drum 410 through a connecting pipe and used to perform additional washing or rinsing. The high-temperature, high-pressure liquid phase refrigerant exhausted from the condenser 442 may be converted to low-temperature, low-pressure liquid phase refrigerant while passing through the first expansion valve 444, and the low-temperature, low-pressure liquid phase refrigerant may be introduced into the second evaporator 449 to cool the ice storage material while exchanging heat with the ice storage material of the second evaporator 449. According to repetition of these refrigerant cycles, a cooling capacity generated by the second evaporator 449 may be stored in the ice storage material. The cold storage may be carried out until freezing of the ice storage material.

According to an embodiment, as air coming out of the drum 410 bypasses the first evaporator 441 and the second evaporator 449 and passes through only the condenser 442 during the washing and dehydration cycle, a temperature of the drum 410 and the circulation duct 420 may be preheated using only a heating effect of the condenser 442, which may perform dehumidification and drying at a fast speed when entering an actual drying cycle, as well as effectively reduce a drying time. Further, refrigerant may be allowed to bypass the first evaporator 441 and pass through the second evaporator 449, in which the ice storage material may be stored, during the washing and dehydration cycle, to perform cold storage in the ice storage material of the second evaporator 449 while simultaneously performing preheating.

Referring to FIGS. 12 and 13, air that has passed through the drum 410 may pass through the first evaporator 441 and the condenser 442 during the beginning and end of the drying cycle, to perform dehumidification and drying, which are inherent functions of the heat pump cycle 440. When entering a drying cycle, the first three-way valve 446 and the second three-way valve 448 of the heat pump cycle 440 may be controlled by receiving a control signal from the controller 470, and thus, refrigerant may pass through the first evaporator 441 to circulate through the compressor 443, the condenser 442, and the first expansion valve 444. This may utilize dehumidification by the first evaporator 441 and a heating effect of the condenser 442 during the drying cycle.

The air moving path and operation of the heat pump cycle 440 will be further described hereinafter. When the circulation fan 430 is activated during the beginning of the drying cycle, the air of the circulation duct 420 may be introduced into the inlet of the drum 410 by the circulation fan 430, and air exhausted from the drum 410 may pass through the first evaporator 441 and the condenser 442 via the circulation duct 420. The first damper 450 may rotate upward to close the inlet of the first passage 421 and the second passage 422 and open the inlet of the first evaporator 441. The second damper 451 may rotate downward to close the inlet of the second passage 422. The reason that the inlet of the second passage 422 is closed is to prevent a portion of the air from flowing backward to the second passage 422 through the second opening 426 having a low passage resistance and merged into the inlet of the condenser 442 again through the first passage 421 before the air that has passed through the drum 410 passes through the first evaporator 441. However, when an evaporating pressure and a condensing pressure are increased above a reference pressure according to advancement of the drying cycle, the inlet of the condenser 442 may be open to allow a portion of the air that has passed through the drum 410 to bypass the first evaporator 441 and be merged into the inlet of the condenser 442, which may reduce a load of the first evaporator 441. The air that has passed through the drum 410 may be directed along the circulation duct 420 and dehumidified by the first evaporator 441, and then heated by the condenser 442. The air heated by the condenser 442 may be introduced into the inlet of the drum 410 to dry out laundry accommodated in the drum 410, and then exhausted to the outlet of the drum 410.

The refrigerant moving path and operation of the heat pump cycle 440 will be described hereinafter. When the compressor 443 is activated, the refrigerant in the circulation pipe 445*a* may be introduced into the first evaporator 441 by the first three-way valve 446 and the second three-way valve 448, and as air that has passed through the drum 410 exchanges heat with refrigerant flowing along the heat exchange pipe 441*a* of the first evaporator 441, the refrigerant may be evaporated by absorbing heat from the air. Low-temperature, low-pressure gas phase refrigerant coming out of the first evaporator 441 may be introduced into the compressor 443, and compressed to generate high-temperature, high-pressure gas phase refrigerant. The high-temperature, high-pressure gas phase refrigerant may be transferred to the condenser 442, and the heat of refrigerant in the condenser 442 may be dissipated to air passing through the condenser 442. The high-temperature, high-pressure refrigerant may be phase-changed to a liquid phase to generate latent heat of condensation while being condensed in the condenser 442, and the latent heat of condensation may be used to heat air passing through the condenser 442. Further, heat capacity dissipated from the condenser 442 may be used to heat water supplied to the condenser 442 by a water supply pipe. The heated water may be directly supplied to the drum 410 through a connecting pipe and used to perform additional washing or rinsing. The high-temperature, high-pressure liquid phase refrigerant exhausted from the condenser 442 may be converted to low-temperature, low-pressure liquid phase refrigerant while passing through the first expansion valve 444, and the low-temperature, low-pressure liquid phase refrigerant may be introduced into the first evaporator 441 and evaporated into a low-temperature, low-pressure gas phase. According to repetition of these refrigerant cycles, a first stage dehumidification and drying by the first evaporator 441 may be carried out.

Referring to FIGS. 14 and 15, as humid air that has passed through the second evaporator 449 has been exposed to the ice storage material during the middle of the drying cycle to perform precooling, a first stage dehumidification may be carried out, and then air that has passed through the second evaporator 449 may pass through the first evaporator 441 for a second stage dehumidification, thereby preventing the refrigerant cycle from being excessively increased on a ph diagram to enhance reliability of the product, as well as increasing a dehumidification capacity promoting drying speed.

When entering the middle of the drying cycle in a full-scale capacity, the first three-way valve 446 and the second three-way valve 448 of the heat pump cycle 440 may be controlled by receiving a control signal from the controller 470, and thus, refrigerant may pass through the first evaporator 441 to circulate through the compressor 443, the condenser 442, and the first expansion valve 444. This may perform a dehumidification by the first evaporator 441 and a heating effect of the condenser 442 during the drying cycle.

The air moving path and operation of the heat pump cycle 440 will be described hereinafter. When the circulation fan 430 is activated during the middle of the drying cycle, the air of the circulation duct 420 may be introduced into the inlet of the drum 410 by the circulation fan 430, and air exhausted from the drum 410 may pass in sequence through the second evaporator 449, the first evaporator 441, and the condenser 442 via the circulation duct 420. The first damper 450 may rotate downward to close the circulation passage at the side of the inlet of the first passage 421. The second damper 451 may rotate upward to close the inlet of the first passage 421 and open the inlet of the second passage 422. The air that has passed through the drum 410 may be moved along the circulation duct 420 and passed through the second evaporator 449 and the condenser 442. The air that has passed through the drum 410 may be hot air at about 40° C. When the ice storage material frozen in the second evaporator 449 during the washing and dehydration cycle prior to the drying cycle is exposed to the hot air, the ice storage material may absorb heat from the hot air, and thus, be converted to a liquid phase while being thawed by the absorbed heat, and a portion of the thawed ice storage material may be phase-changed to a gas phase. Due to this, air that has passed through the second evaporator 449 may be precooled to perform the first stage dehumidification. The dehumidified air coming out of the second passage 422 may be introduced into the first evaporator 441, and dehumidified in a second stage by the first evaporator 441, and then may be introduced and heated in the condenser 442. The air dehumidified, dried, and heated by the condenser 442 may be introduced into the inlet of the drum 410 to dry out laundry accommodated in the drum 410, and then may be exhausted to the outlet of the drum 410.

Considering the refrigerant moving path and the heat pump cycle 440 during the middle of the drying cycle, the refrigerant of the circulation pipe may be introduced and evaporated in the first evaporator 441 by operation of the compressor 443. Low-temperature, low-pressure gas phase refrigerant coming out of the first evaporator 441 may be introduced and compressed in the compressor 443 to generate high-temperature, high-pressure gas phase refrigerant. The high-temperature, high-pressure gas phase refrigerant may be transferred to the condenser 442 to dissipate the heat of refrigerant by the condenser 442. The heat dissipated by the condenser 442 may be used to heat air introduced into the drum 410 or heat water supplied to the condenser 442 by a water supply pipe to make hot water and perform additional washing or rinsing with the hot water. Then, high-temperature, high-pressure liquid phase refrigerant exhausted from the condenser 442 may be changed into low-temperature, low-pressure liquid phase refrigerant while passing through the first expansion valve 444, and the low-temperature, low-pressure liquid phase refrigerant may be introduced into the first evaporator 441. According to repetition of these refrigerant cycles, a first stage dehumidification by the second evaporator 449, and a second stage dehumidification and drying by the first evaporator 441 may be carried out.

Figure 16:
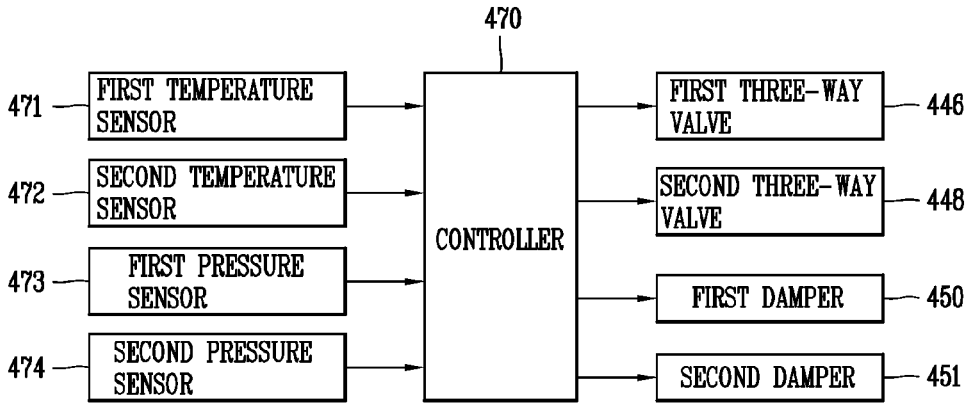
FIG. 16 is a block diagram of a control apparatus for controlling a clothes treating apparatus according to an embodiment.
Figure 17:
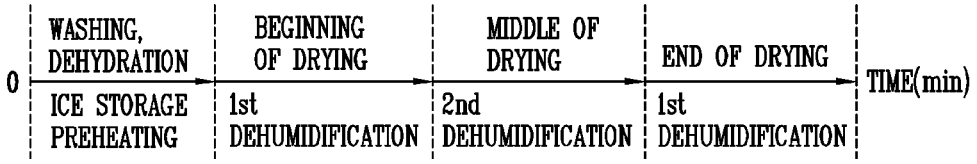
FIG. 17 is a schematic diagram of a control method during washing and drying cycles in stages in a clothes treating apparatus according to an embodiment.

FIG. 16 is a block diagram of a control apparatus for controlling a clothes treating apparatus according to an embodiment. FIG. 17 is a schematic diagram of a control method during washing and drying cycles in stages in a clothes treating apparatus according to an embodiment. A control apparatus illustrated in FIG. 16 may determine a time point at which an Ice storage material frozen during the washing and dehydration cycle is exposed to hot air.

The effect of warming up the drum 410 and the circulation duct 420 may be obtained by the ice storage material and preheating during the washing and dehydration cycle. Then, the drying cycle may be started to perform the first dehumidification and evaporation while an air flow may be formed through the circulation duct 420. Air may then be directed to the second passage 422 at an appropriate time point to perform a first precooling by the second evaporator 449 in which the ice storage material may be stored. The second dehumidification may be performed by the first evaporator 441, wherein the appropriate time point is a time point at which the refrigerant cycle is saturated. This process may increase the evaporating pressure and the condensing pressure above a reference pressure such that the heat capacity dissipated from the condenser 442 may exceed a capacity which may be treated in the first evaporator 441, thereby causing a problem in reliability of the system. In this case, in order to decrease a load of the first evaporator 441, air may be allowed to pass through the second evaporator 449 in which the ice storage material is stored prior to passing through the first evaporator 441 to perform precooling in the second evaporator 449, thereby enhancing system stabilization. Accordingly, it is important to allow hot air exhausted from the drum 410 to pass through the second evaporator 449 and the condenser 442 at an appropriated time point. Though this embodiment is limited to the middle of the drying cycle, it is important to know exactly a time point at which the cycle is saturated to stabilize the system.

According to an embodiment, a first pressure sensor 473 may be provided on or at the first evaporator 441 to sense an evaporating pressure. Further, a second pressure sensor 474 may be provided on or at the condenser 442 to sense a condensing pressure. Furthermore, a first temperature sensor 471 may be provided on or at the first evaporator 441 to measure an evaporating temperature of the evaporator, and a second temperature sensor 472 may be provided on or at the condenser 442 to measure a condensing temperature of the condenser 442.

The controller 470 may receive at least one of the evaporating pressure or the condensing pressure from the first pressure sensor 473 and the second pressure sensor 474 and compare the sensed pressure with a reference pressure, and when the sensed pressure is above the reference pressure, the controller 470 may control the first three-way valve 446 and the second three-way valve 448 to allow refrigerant to pass through the first evaporator 441, and may control the first damper 450 and the second damper 451 to allow air that has passed through the drum 410 to pass through the second evaporator 449, the first evaporator 441, and the condenser 442 through the second passage 422, thereby controlling the flow of refrigerant and air. As a result, cold energy previously stored in the ice storage material may be used at an appropriate time point to perform precooling, thereby stabilizing the system.

The controller 470 may sense a time point at which the refrigerant cycle is saturated using the first temperature sensor 471 and the second temperature sensor 472 instead of the first pressure sensor 473 and the second pressure sensor 474. For example, a case in which the evaporating temperature and the condensing temperature measured by the first temperature sensor 471 and the second temperature sensor 472 exceed a reference temperature may be determined as an appropriate time point to expose the second evaporator 449 to hot air. The time point may also be determined by calculating or estimating based on experimental data indicating a relationship between the evaporating temperature and the condensing temperature and the evaporating pressure and the condensing pressure. Thus, it may be possible to control the first three-way valve 446, the second three-way valve 448, the first damper 450, and the second damper 451.

Figure 18:
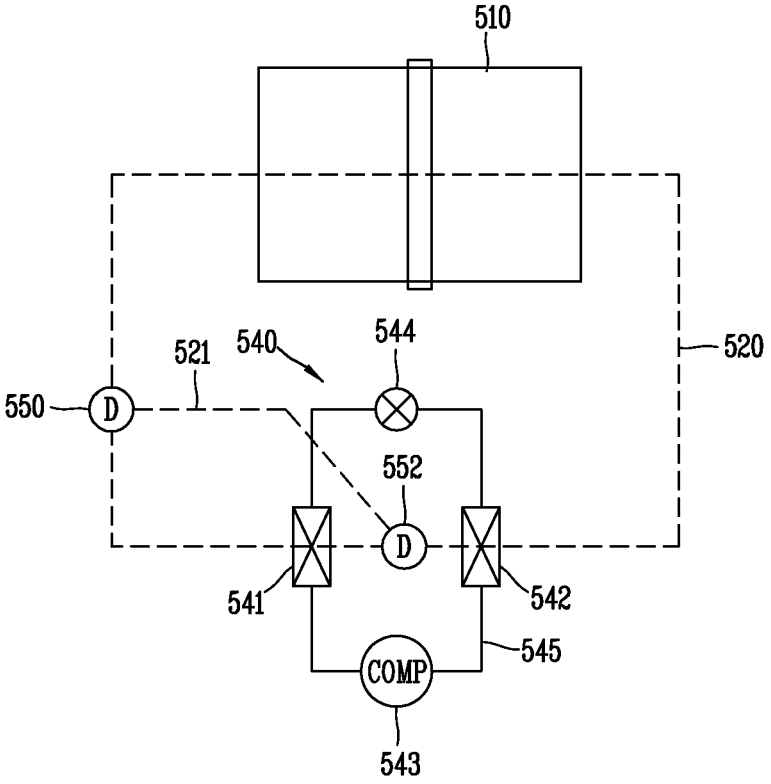
FIGS. 18 through 20 are schematic diagram of a clothes treating apparatus having a heat pump cycle according to another embodiment, wherein in particular.
Figure 19:
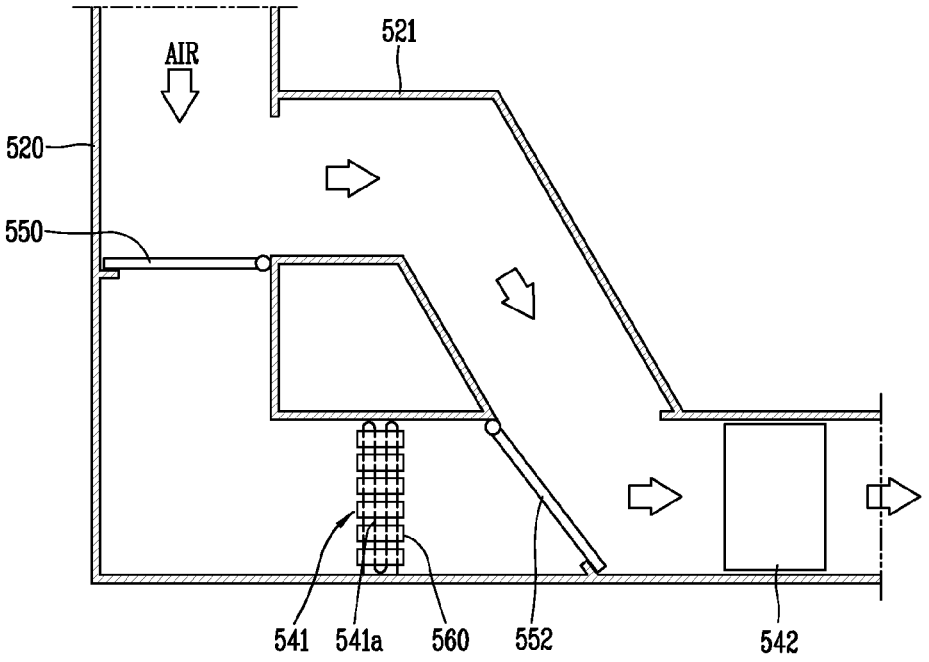
Figure 20:
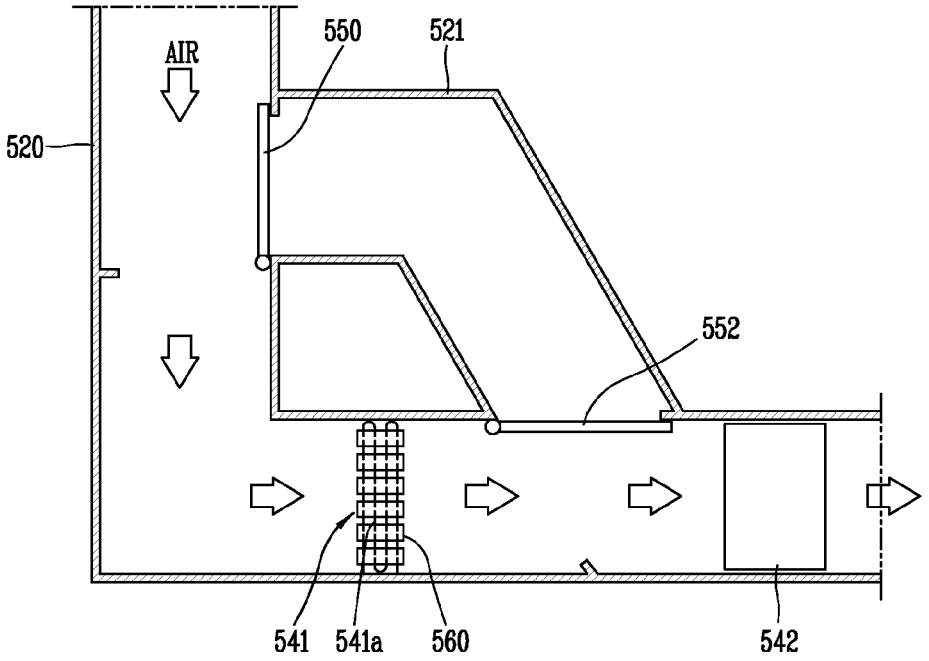

FIGS. 18 through 20 are schematic diagrams of a clothes treating apparatus having a heat pump cycle according to another embodiment. In particular, FIG. 18 illustrates a schematic diagram of the whole clothes treating apparatus according to the this embodiment. FIG. 19 is a view illustrating that air exhausted from a drum may bypass a first evaporator through a bypass passage and pass through only a condenser. FIG. 20 is a view illustrating that air exhausted from the drum may pass through the first evaporator and the condenser along the circulation duct.

According to the clothes treating apparatus illustrated in FIG. 18, in contrast to the first evaporator 141 of FIG. 2, first evaporator 541 may not be brought into contact with outside air, and a plurality of ice storage blocks 560, in which an ice storage material may be stored, may be provided in the first evaporator 541 to be separated from each other. Accordingly, the third damper and fourth damper installed at the side of the intake port 122 and exhaust port 123 on the partial section of the circulation duct 120 in FIG. 2 may be removed from the embodiment of FIG. 18. A control apparatus for controlling a clothes treating apparatus according to this embodiment may include controller 570 in communication with each of the components of the clothes treating apparatus. The controller 570 may send a control signal to each of the components of the clothes treating apparatus to control operation of each component. The other components may be the same as or similar to those of FIG. 2, and thus, description thereof has been omitted.

Considering a method for a controlling a clothes treating apparatus according to this embodiment, first damper 550 and second damper 552 may be controlled during the washing and dehydration cycle to close a partial section of circulation duct 520 and open bypass passage 521. Due to this, air that has passed through drum 510 may bypass the first evaporator 541 and pass through condenser 542, and water supplied to the condenser 542 may be heated using only a heating effect of the condenser 542 to generate hot water. The hot water may be used to perform additional washing or rinsing. Further, the drum 510 and the circulation duct 520, for example, may be preheated prior to the drying cycle to perform drying at a fast speed when entering an actual drying cycle, thereby reducing a drying time.

Further, the ice storage material and refrigerant may exchange heat with each other in the first evaporator 541 during the washing and dehydration cycle, and thus, the refrigerant may absorb heat from the ice storage material, and the ice storage material may be frozen when cooled by the refrigerant. As a result, a cooling capacity may be stored in the ice storage material during the washing and dehydration cycle (refer to FIG. 19), and the passage may be changed at an appropriate time point (a time point at which the refrigerant cycle is saturated) to allow air that has passed through the drum 510 to pass through the first evaporator 541 (refer to FIG. 20), thereby further increasing the dehumidification capacity in the first evaporator 541 due to the cooling energy stored in the ice storage material.

Embodiments disclosed herein provide a clothes treating apparatus having a heat pump cycle capable of preheating a drum and a circulation duct, for example, during washing, rinsing, and dehydration to reduce a drying time.

Embodiments disclosed herein provide a clothes treating apparatus with a heat pump cycle for performing a washing cycle and a drying cycle that may include a drum configured to accommodate a subject or items, such as laundry; a heat pump cycle provided with a first evaporator, a compressor, a condenser, and a first expansion valve connected by a first circulation pipe to circulate a working fluid, such as a refrigerant, to dissipate heat of the working fluid compressed in the compressor by the condenser and heat air introduced into the drum using the dissipated heat during the drying cycle; a circulation duct configured to form a circulation passage to allow air that has passed through the drum to circulate to the drum while passing through the first evaporator and the condenser; a circulation fan configured to provide a circulation power to circulate air along the circulation duct; and a controller configured to drive the heat pump cycle and the circulation fan during the washing cycle to preheat at least one of the drum or the circulation duct. The clothes treating apparatus may further include a bypass passage provided on the circulation duct to allow air that has passed through the drum to bypass the first evaporator and pass through the condenser; and a first damper and a second damper provided at a first side and a second side of the bypass passage connected to the circulation duct, respectively, to open and close an inlet and an outlet of the bypass passage. The controller may control the first and the second damper to open the bypass passage during the washing cycle, and heat air coming out of the drum while bypassing the first evaporator through the bypass passage and passing through the condenser.

The circulation duct may include an intake port and an exhaust port formed to communicate with outside air at an upstream side and a downstream side of the first evaporator, a third damper and a fourth damper provided on or in the intake port and the exhaust port, respectively, to open and close the intake port and the exhaust port; and an intake fan provided on or in at least one of the intake port or the exhaust port to blow outside air to the first evaporator. The controller may control the third damper and the fourth damper to open the intake port and the exhaust port during the washing cycle, and the heat pump cycle may absorb heat of outside air inhaled into the first evaporator to transfer it to the condenser.

In order to flow water through the condenser to make hot water and perform additional washing or rinsing cycle using the hot water, the clothes treating apparatus may further include a water supply portion or water supply; a water supply pipe configured to connect the water supply portion to the condenser to supply water from the water supply portion to the condenser; a water supply valve provided on the water supply pipe to open and close the water supply pipe; and a connecting pipe configured to connect the condenser to the drum to transfer water coming out of the condenser to the drum. The controller may control the water supply valve to open the water supply valve during the washing cycle such that water supplied to the condenser may be heated by the condenser, and the heated water may be transferred to the drum and used as washing water or rinsing water.

The heat pump cycle may include a second evaporator connected in parallel to the first evaporator by a second circulation pipe formed to circulate the working fluid, and a first three-way valve and a second three-way valve provided at a first side and a second side of the second circulation pipe, respectively, to control a flow direction to allow the working fluid to selectively pass through the first evaporator and the second evaporator. The controller may control the first three-way valve and the second three-way valve such that the working fluid that has passed through the first expansion valve during the washing cycle may be circulated while bypassing the first evaporator and passing through the second evaporator, and air coming out of the drum may be heated while passing through the condenser.

The heat pump cycle may include a second evaporator connected in series to the first evaporator by a second circulation pipe formed to circulate the working fluid; a second expansion valve provided on the second circulation pipe connected between the condenser and the second evaporator; and first and second three-way valves provided at a first side and a second side of the second circulation pipe, respectively, to control a flow direction to allow the working fluid to pass through at least one of the first evaporator or the second evaporator. The controller may control the first and second three-way valves such that the working fluid that has passed through the evaporator during the washing cycle is circulated while bypassing the first expansion valve and passing through the second expansion valve, the second evaporator, and the first evaporator, and air coming out of the drum is heated while passing through the condenser.

The second evaporator may include an intake portion or intake configured to intake outside air; an exhaust portion or exhaust configured to exhaust air to the outside air; and an intake fan provided on at least one of the intake portion or the exhaust portion to blow the outside air to the second evaporator. The controller may control operation of the intake fan to inhale the outside air to the second evaporator during the washing cycle, and the heat pump cycle may absorb the heat of the outside air introduced through the intake portion from the evaporator and dissipate it from the condenser.

The first evaporator may include a plurality of ice storage blocks configured to store an ice storage material therein, and provided to be separated from each other to allow air to pass therethrough; and a heat exchange pipe configured to flow working fluid thereinto, and coupled through the plurality of ice storage blocks to allow the working fluid to exchange heat with the ice storage material. The ice storage material may be a phase change material, and may be frozen by exchanging heat with the working fluid or thawed by exchanging heat with air coming out of the drum. The second evaporator may be provided at an outside of the circulation duct. The second evaporator may include a plurality of ice storage blocks configured to store an ice storage material therein, and provided to be separated from each other to exchange heat with air coming out of the drum; and a heat exchange pipe configured to flow a working fluid therethrough, and coupled through the plurality of ice storage blocks to allow the working fluid to exchange heat with the ice storage material. The ice storage material may be a phase change material, and may be frozen by exchanging heat with the working fluid or thawed by exchanging heat with air coming out of the drum.

The clothes treating apparatus may further include a first passage formed on or in the circulation duct to allow air that has passed through the drum to bypass the first evaporator and the second evaporator and pass through the condenser; a first damper rotatably provided within the circulation duct to selectively open and close an upstream side of the first evaporator and the first passage; a second passage formed on or in the circulation duct to allow air that has passed through the drum to pass through the second evaporator, the first evaporator, and the condenser; and a second damper rotatably provided on or in the second passage to selectively open and close an upstream side of the second evaporator and the second passage.

The first passage and the second passage may be formed on or at a top of the first evaporator. The first passage and the second passage may be formed in a branched manner from each other within a passage change portion formed to be protruded from an upper side of the circulation duct, and a first opening portion or opening, a second opening portion or opening, and a third opening portion or opening may be formed to be separated from each other in an air moving direction at a boundary portion or boundary between a bottom of the passage change portion and the top of the circulation duct. The first opening portion may communicate with an inlet of the first passage and an inlet of the second passage, and the second opening portion and the third opening portion may communicate with an outlet of the first passage and an outlet of the second passage, respectively.

The passage change portion may include a first partition portion or partition separated from the top of the circulation duct and horizontally formed therefrom to branch out the first passage and the second passage to a top and bottom of the passage change portion, respectively, and a second partition portion or partition extended from a rear end portion or end of the first partition portion to a top of the first evaporator to partition an outlet of the first passage and an outlet of the second passage. The controller may control the first damper and the second damper during at least one of the washing cycle or the dehydration cycle to close the circulation passage and the second passage connected to the first evaporator such that air that has passed through the drum may be heated while bypassing the first evaporator and the second evaporator through the first passage and passing through the condenser.

The controller may control the first three-way valve and the second three-way valve during at least one of the washing cycle or the dehydration cycle to close a refrigerant passage connected to the first evaporator, and the ice storage material may be cooled and frozen by the working fluid of the second evaporator as the working fluid that has passed through the first expansion valve bypasses the first evaporator and passes through the second evaporator. The controller may control the first damper and the second damper during at least one of a beginning or end of the drying cycle to close the first passage and the second passage such that air that has passed through the drum may be cooled and dehumidified in a first stage while passing through the first evaporator along the circulation duct.

The controller may control the first damper and the second damper during a middle of the drying cycle to close an upstream side of the first evaporator and the first passage such that air that has passed through the drum may be primarily cooled and dehumidified in a first stage by latent heat due to a phase change of the ice storage material while passing through the second evaporator through the second passage, and air that has passed through the second evaporator may be secondarily cooled and dehumidified in a second stage while passing through the first evaporator.

Air that has passed through the drum during washing, rinsing and dehydration may be circulated to bypass the evaporator installed or provided on or in the circulation duct and pass through the condenser, and the drum and the circulation duct may be preheated using only the heating (dissipation) of the condenser on a closed loop of the refrigerant cycle in which a refrigerant, which is a working fluid, may be circulated, thereby performing dehumidification and drying at a fast speed when entering an actual drying cycle. As a result, it may be possible to greatly reduce a drying time.

Further, as refrigerant is circulated to pass through the second evaporator mounted or provided with an ice storage block for a long period of time during which washing, rinsing, and dehydration are carried out, an ice storage material stored in the ice storage block of the second evaporator may be frozen to store a cooling capacity, and humid air that has passed through the drum may be selectively exposed to the ice storage block at a specific time point of an actual drying section to perform precooling, thereby enhancing a dehumidification cooling capacity as well as decreasing an evaporating pressure of the first evaporator and a condensing pressure of the condenser to promote stabilization of the heat pump cycle.

Furthermore, a method of ice storage may absorb a heat capacity of an ice storage material through a refrigerant and dissipate it from the condenser while at a same time performing cooling due to the ice storage material during the washing and dehydration cycle other than the drying cycle, thereby obtaining an effect of performing warming-up of the drum and the circulation duct at a same time for high-speed dehumidification drying of the heat pump cycle while at the same time preheating an internal system of the heat pump cycle, for example, the evaporator and the circulation duct, for example, to perform drying without discarding cooling capacity generated by a refrigerant cycle to the outside.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus having a heat pump cycle for performing a washing cycle and a drying cycle, the clothes treating apparatus comprising:

a drum configured to accommodate an item to be treated;

a heat pump cycle including a first evaporator, a compressor, a condenser, and a first expansion valve connected by a first circulation pipe to circulate a working fluid to dissipate a heat of the working fluid from the condenser to heat air introduced into the drum during the drying cycle;

a circulation duct configured to form a circulation passage to allow air that has passed through the drum to recirculate to the drum while passing through the first evaporator and the condenser;

a circulation fan configured to circulate air along the circulation duct; and a controller configured to drive the heat pump cycle and the circulation fan during the washing cycle to preheat at least one of the drum or the circulation duct, wherein the heat pump cycle includes a second evaporator connected in parallel to the first evaporator by a second circulation pipe formed to circulate the working fluid, wherein the second evaporator includes:

a plurality of ice storage blocks configured to store an ice storage material therein, and provided to be separated from each other to exchange heat with the ice storage material while passing through air coming out of the drum; and a plurality of heat exchange pipes configured to receive a working fluid to flow therethrough and coupled with the plurality of ice storage blocks to allow the working fluid to exchange heat with the ice storage material.

2. The clothes treating apparatus of claim 1, further including:

a water supply;

a water supply pipe configured to connect the water supply to the condenser to supply water from the water supply to the condenser;

a water supply valve provided on the water supply pipe to open and close the water supply pipe; and a connecting pipe configured to connect the condenser to the drum to transfer water coming out of the condenser to the drum, wherein the controller controls the water supply valve to open the water supply valve during the washing cycle such that water supplied to the condenser is heated by the condenser, and the heated water is transferred to the drum and used as washing water or rinsing water.

3. The clothes treating apparatus of claim 1, wherein the ice storage material is a phase change material, which is frozen by exchanging heat with the working fluid or thawed by exchanging heat with air coming out of the drum.

4. The clothes treating apparatus of claim 1, further including:

a first passage formed on the circulation duct to allow air that has passed through the drum to bypass the first evaporator and the second evaporator and pass through the condenser;

a first damper rotatably provided in the circulation duct to selectively open and close an upstream side of the first evaporator and the first passage;

a second passage formed on the circulation duct to allow air that has passed through the drum to pass through the second evaporator, the first evaporator, and the condenser; and a second damper rotatably provided in the second passage to selectively open and close an upstream side of the second evaporator and the second passage.

5. The clothes treating apparatus of claim 4, wherein the first passage and the second passage are formed above the first evaporator.

6. The clothes treating apparatus of claim 4, wherein the first passage and the second passage are formed in a branched manner from each other within a passage change portion that protrudes from an upper side of the circulation duct, wherein a first opening, a second opening, and a third opening are formed to be separated from each other in an air moving direction at a boundary between a bottom of the passage change portion and a top of the circulation duct, and wherein the first opening communicates with an inlet of the first passage and an inlet of the second passage, and the second opening and the third opening communicate with an outlet of the first passage and an outlet of the second passage, respectively.

7. The clothes treating apparatus of claim 6, wherein the passage change portion includes:

a first partition vertically separated from the top of the circulation duct and that extends horizontally to separate the first passage and the second passage; and a second partition that extends from a rear end of the first partition to a top of the first evaporator to partition an outlet of the first passage and an outlet of the second passage.

8. The clothes treating apparatus of claim 4, wherein the controller controls the first damper and the second damper during at least one of the washing cycle or the dehydration cycle to close the circulation passage and the second passage such that air that has passed through the drum is heated while bypassing the first evaporator and the second evaporator through the first passage and then passes through the condenser.

9. The clothes treating apparatus of claim 4, wherein the controller controls the first three-way valve and the second three-way valve during at least one of the washing cycle or dehydration cycle to close a refrigerant passage connected to the first evaporator, and the ice storage material is cooled and frozen by the working fluid of the second evaporator as the working fluid that has passed through the first expansion valve bypasses the first evaporator and passes through the second evaporator.

10. The clothes treating apparatus of claim 4, wherein the controller controls the first damper and the second damper during at least one of a beginning and an end of the drying cycle to close the first passage and the second passage such that air that has passed through the drum is cooled and dehumidified in a first stage while passing through the first evaporator along the circulation duct.

11. The clothes treating apparatus of claim 4, wherein the controller controls the first damper and the second damper during a middle of the drying cycle to close an upstream side of the first evaporator and the first passage such that air that has passed through the drum is primarily cooled and dehumidified in a first stage by latent heat due to a phase change of the ice storage material while passing through the second evaporator through the second passage, and air that has passed through the second evaporator is secondarily cooled and dehumidified in a second stage while passing through the first evaporator.

* * * * *